US007630655B2

(12) United States Patent
Namiki et al.

(10) Patent No.: US 7,630,655 B2
(45) Date of Patent: Dec. 8, 2009

(54) IMAGE FORMING APPARATUS AND DEVELOPER REMAINING AMOUNT DETECTING METHOD

(75) Inventors: Takayuki Namiki, Yokohama (JP); Nobuo Komiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 338 days.

(21) Appl. No.: 11/680,056

(22) Filed: Feb. 28, 2007

(65) Prior Publication Data

US 2007/0206965 A1 Sep. 6, 2007

(30) Foreign Application Priority Data

Mar. 1, 2006 (JP) ..... 2006-055608
Feb. 23, 2007 (JP) ..... 2007-044762

(51) Int. Cl.
*G03G 15/08* (2006.01)

(52) U.S. Cl. ..... 399/27

(58) Field of Classification Search ..... 399/24, 399/27, 61, 62, 63
See application file for complete search history.

(56) References Cited

U.S. PATENT DOCUMENTS

| | | | | |
|---|---|---|---|---|
| 5,946,522 | A | 8/1999 | Inami | 399/27 |
| 6,226,464 | B1 * | 5/2001 | Suwa et al. | 399/27 |
| 6,591,070 | B1 * | 7/2003 | Shoji et al. | 399/27 |
| 2007/0206966 | A1 | 9/2007 | Komiyama et al. | 399/27 |

FOREIGN PATENT DOCUMENTS

| | | |
|---|---|---|
| JP | 7-325473 | 12/1995 |
| JP | 9-190067 | 7/1997 |
| JP | 2001-242690 | 9/2001 |
| JP | 2005-309145 | 11/2005 |

OTHER PUBLICATIONS

Japanese Office Action mailed Jun. 17, 2008 in Application No. 2007-044762, with English-language translation.
Machine translation of JP2005-309145 A., Date: Nov. 4, 2005.

* cited by examiner

*Primary Examiner*—Hoang Ngo
(74) *Attorney, Agent, or Firm*—Fitzpatrick, Cella, Harper & Scinto

(57) ABSTRACT

An image forming apparatus, which uses a developing device including: a developer carrying member developing an electrostatic latent image formed on an electrophotographic photosensitive member with a developer; a developer containing portion containing the developer; an agitating member provided rotatably in the developer containing portion to agitate the developer; and a developer remaining amount detecting member outputting a signal for detecting the remaining amount of the developer contained in the developer containing portion, the image forming apparatus including a main body controller to which the signal is input, and which detects the remaining amount of the developer, the main body controller detecting the remaining amount of the developer in the developer containing portion based on the amount of change per a unit revolution number of the agitating member in the band of fluctuation in the signal in association with the rotation of the agitating member.

8 Claims, 22 Drawing Sheets

IMAGE FORMING APPARATUS AND DEVELOPER REMAINING AMOUNT DETECTING METHOD

BACKGROUND OF THE INVENTION

1. Field of the Invention

The present invention relates to electrophotographic image forming apparatuses, for example, laser beam printers, copying machines, facsimiles, or multi-function printers being the combination thereof.

Furthermore, the present invention, in such image forming apparatuses, relates to remaining amount detecting methods of a developer contained in a developer containing portion of a developing device for developing an electrostatic latent image, which is formed on an electrophotographic photosensitive member.

2. Description of the Related Art

FIG. 21 illustrates one example of electrophotographic image forming apparatuses from which a process cartridge is constructed to be removable.

In this example, a process cartridge 13 includes a drum-shaped electrophotographic photosensitive member (hereinafter referred to as "photosensitive drum") 1, being an image bearing member rotating in a direction indicated by the arrow A in FIG. 21. With a charger 2 uniformly charging the photosensitive drum 1 and an exposure device 6 irradiating an optical image on the photosensitive drum 1, an electrostatic latent image is formed on the photosensitive drum 1. The electrostatic latent image on the photosensitive drum 1 is developed into a visible image by a developing device 3, which contains a developer (hereinafter referred to as "toner") T. Further, the visible image that is a toner image is transferred onto a recording sheet P by a transfer device 4. The toner image having been transferred onto the recording sheet P is fixed by a fixing device 7.

On the other hand, toner remaining on the photosensitive drum 1 after transfer is removed by a cleaning device 5.

The above-mentioned photosensitive drum 1, charger 2, developing device 3, and cleaning device 5 are integrally made into a process cartridge 13.

FIG. 22 is a view illustrating one example of a conventional developing device 3 of the same construction as the developing device 3 of the above-mentioned process cartridge 13.

The developing device 3 is provided with a developing container 3*a* as a developer containing portion. In the developing container 3*a*, there are provided a developing sleeve 8 as a developer carrying member carrying and conveying the contained toner T, a developing blade 11 regulating the layer of toner T carried on the developing sleeve 8 into a uniform thickness, and an agitating member 10 agitating toner in the developing container 3*a*.

Furthermore, there is disposed in the developing container 3*a* an antenna member 14 as a toner remaining amount detecting member forming a developer (toner) remaining amount detecting unit for detecting the remaining amount of toner in the developing container 3*a*.

As a toner remaining amount detecting unit, as illustrated in FIG. 22, one that detects the change in capacitance accompanied with the change of remaining amount of toner in the developing container 3*a* with an antenna member 14 disposed in parallel with the developing sleeve 8, to estimate the remaining amount of toner, is known (see Japanese Patent Application Laid-Open No. H09-190067).

In addition, a toner remaining amount detecting unit may be one that estimates the remaining amount of toner and detects troubles of the agitating member 10 by utilizing the band of fluctuation in capacitance fluctuating in association with rotation of the agitating member 10 (see Japanese Patent Application Laid-Open No. 2001-242690).

However, there have been the following problems in the above-mentioned conventional examples.

That is, recently owing to downsizing of a developing device 3, a difference between the electrical capacitance (hereinafter simply reffered to as either "capacitance" or "capacitances") in the case of sufficient remaining amount of toner and the capacitance in the case of small remaining amount of toner becomes small. Therefore, in a toner remaining amount detecting unit disclosed in Japanese Patent Application Laid-Open No. H09-190067, the amount of change in capacitance necessary for making detection when the remaining amount of toner becomes small, that is, for detecting that the amount of toner becomes low (hereinafter referred to as toner LOW) becomes smaller.

Furthermore, in a toner remaining amount detecting unit disclosed in Japanese Patent Application Laid-Open No. 2001-242690, toner remaining amount detection is made based on the band of fluctuation in capacitance in association with rotation of an agitating member. In this case, toner remaining amount detection can be made even if there is just a small amount of change in capacitance when toner sufficiently remains and when the amount of toner becomes low. However, the band of fluctuation in capacitance in association with rotation of an agitating member differs depending on the position of an antenna member, or use environment even if remaining amounts of toner in a developing container are the same.

Accordingly, by the method of detecting that the band of fluctuation has reached a reference value having been preliminarily set as in Japanese Patent Application Laid-Open No. 2001-242690, errors are likely to occur between the remaining amount of toner having been detected and an actual remaining amount of toner.

SUMMARY OF THE INVENTION

Hence, it is an object of the present invention to provide an image forming apparatus and a developer remaining amount detecting method in which detection accuracy of the remaining amount of a developer in a developer containing portion in a developing device is improved.

In addition, it is another object of the present invention to provide an image forming apparatus, which employs a developing device including: a developer carrying member for developing an electrostatic latent image formed on an electrophotographic photosensitive member with a developer; a developer containing portion containing the developer; an agitating member, which is provided rotatably in the developer containing portion to agitate the developer; and a developer remaining amount detecting member outputting a signal for detecting the remaining amount of the developer contained in the developer containing portion, the developer remaining amount detecting member being disposed at a position closer to the developer carrying member than to a center of rotation of the agitating member in the developer containing portion, the image forming apparatus comprising a main body controller to which the signal is input, and which determines the remaining amount of the developer, the main body controller determining the remaining amount of the developer in the developer containing portion to indicate that the remaining amount of the developer in the developer containing portion reaches a predetermined amount after the amount of change per a unit number of revolutions of the agitating member in the band of fluctuation in the signal in association with the rotation of the agitating member becomes zero.

Moreover, it is still another object of the present invention to provide a detecting method of detecting the remaining amount of a developer contained in a developer containing portion, in an image forming apparatus which employs a developing device including: a developer carrying member developing an electrostatic latent image formed on an electrophotographic photosensitive member with a developer; the developer containing portion containing the developer; an agitating member, which is provided rotatably in the developer containing portion to agitate developer; and a developer remaining amount detecting member outputting a signal for detecting the remaining amount of a developer contained in the developer containing portion, the developer remaining amount detecting member being disposed at a position closer to the developer carrying member than to a center or rotation of the agitating member in the developer containing portion, the detecting method comprising the process of determining the remaining amount of the developer in the developer containing portion to indicate that the remaining amount of the developer in the developer containing portion reaches a predetermined amount after the amount of change per a unit number of revolutions of the agitating member in the band of fluctuation in the signal in association with the rotation of the agitating member becomes zero.

Further features of the present invention will become apparent from the following description of exemplary embodiments with reference to the attached drawings.

DESCRIPTION OF THE EMBODIMENTS

Figure 1:
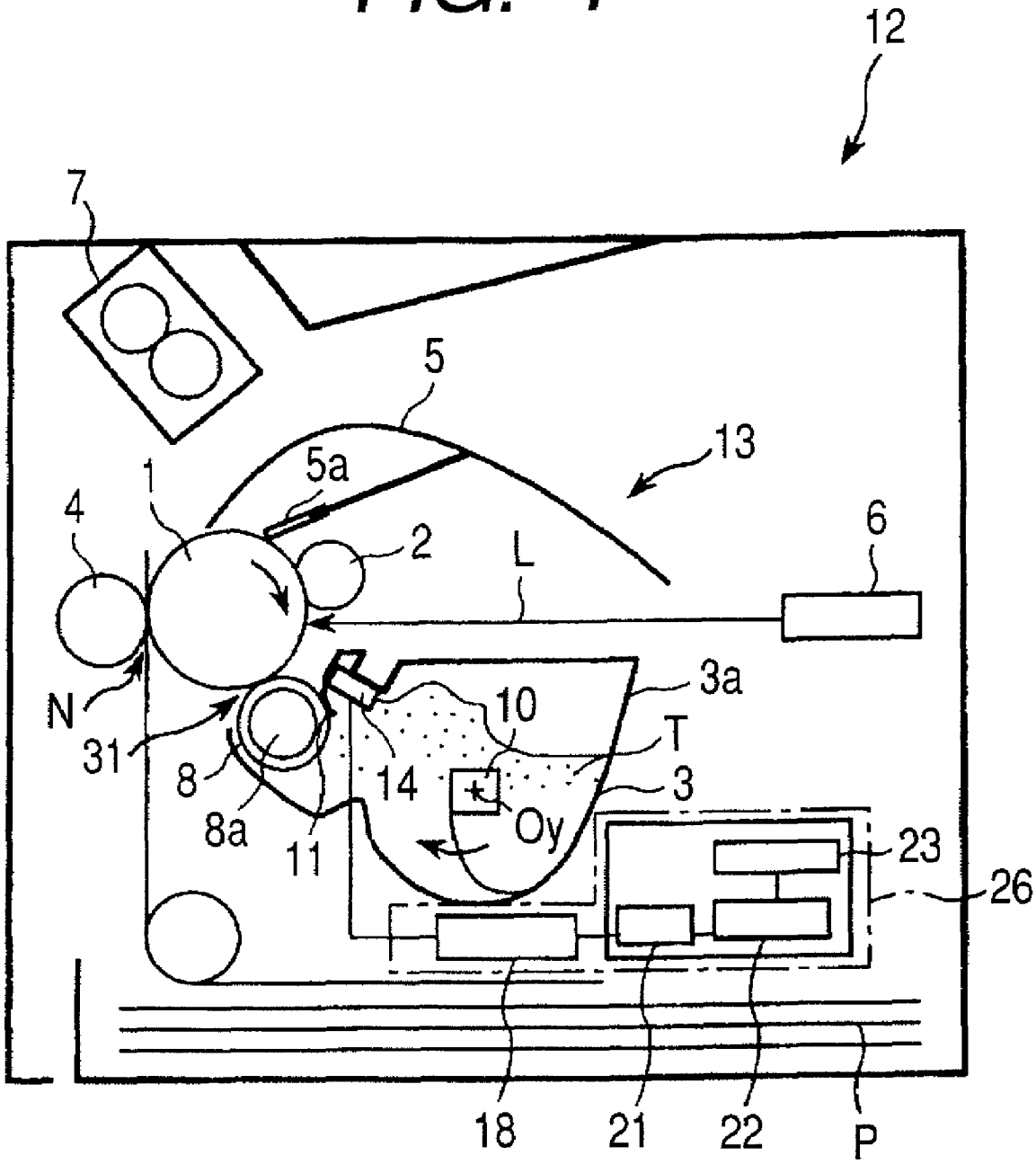
FIG. 1 is a schematic cross-sectional configuration diagram illustrating one embodiment of an image forming apparatus according to the present invention.

Hereinafter, an image forming apparatus and a developer remaining amount detecting method according to the present invention will be described in further detail referring to the drawings.

Embodiment 1

<Description of Image Forming Apparatus and Image Forming Process>

FIG. 1 illustrates a schematic configuration of an electrophotographic laser beam printer, being one embodiment of an image forming apparatus according to the present invention.

An image forming apparatus 12 utilizing an electrophotographic technology according to this embodiment is provided with a drum-shaped electrophotographic photosensitive member (hereinafter referred to as "photosensitive drum") 1 as an image bearing member. Around the photosensitive drum 1, there are arranged in order along the direction of rotation of the photosensitive drum 1 a charging roller 2 as a charging unit, a developing device 3 as a developing unit, a transfer roller 4 as a transfer unit, and a cleaning device 5 including a cleaning blade 5*a* as a cleaning unit. Furthermore, there is arranged above and between the charging roller 2 and the developing device 3 an exposure device 6. There is arranged a fixing device 7 on the downstream side of a transfer nip N formed between the photosensitive drum 1 and the transfer roller 4 in a conveying direction of recording sheets.

In this embodiment, out of the above-mentioned components, the photosensitive drum 1, the charging roller 2, the developing device 3, and the cleaning device 5 are constructed to be an integral unit, to form a process cartridge 13 detachably mountable to an image forming apparatus main body.

In this embodiment, the photosensitive drum 1 includes an OPC (organic photoconductive) layer on a drum base body made of aluminum, and is driven to rotate in a direction indicated by the arrow (in a clockwise direction) at a predetermined circumferential speed by a driving unit (not shown) provided on the image forming apparatus main body side. The photosensitive drum 1 is uniformly charged to a negative polarity by the charging roller 2 being in contact with the photosensitive drum 1 in the rotation process of the photosensitive drum 1.

The charging roller 2 as a charging unit uniformly charges the photosensitive drum 1 to a predetermined polarity and electric potential with a charging bias applied from a charging bias power supply (not shown). As a charging bias, a DC voltage Vdc, which corresponds to a dark section potential Vd on the photosensitive drum, superimposed on an AC voltage Vpp by which the charging roller 2 is sufficiently electrically discharged, is applied. An alternating current AC component of the charging bias makes such a constant current control that a constant current is applied all the time between the photosensitive drum 1 and the charging roller 2.

The exposure device 6 outputs from a laser output portion (not shown) image information input from a personal computer (not shown) in the form of a laser beam (exposure beam) modulated in accordance with time-series electric digital image signals by a video controller (not shown). An exposure beam L makes scanning and exposure of the charged surface of photosensitive drum 1, thereby forming an electrostatic latent image corresponding to image information.

The developing device 3 includes a developing container 3*a* as a developer containing portion, and contains a developer T therein. Furthermore, there is arranged in the opening of the developing device 3 a developing sleeve 8 acting as a developer carrying member made of a non-magnetic developing member such as aluminum pipe which developing sleeve 8 is opposed to the photosensitive drum 1 surface, and is capable of rotating with keeping a predetermined distance.

In this embodiment, by using the developing sleeve 8 having a cross section radius of 6 mm, downsizing of a process cartridge and an image forming apparatus main body is achieved.

In addition, in the developing container 3*a*, there are provided an agitating member 10 rotatable in a direction indicated by the arrow for agitating a developer, and a developing blade 11 for frictionally charging a developer on the developing sleeve 8. In this embodiment, as a developer T, a mono-component magnetic developer (hereinafter referred to as "toner") of an average particle diameter of 7 μm is used. Developers are not limited to mono-component magnetic toner.

The agitating member 10 uses a PPS sheet having a thickness of 100 μm, and makes one revolution in approximately 10 seconds in this embodiment. Toner T is conveyed to the developing sleeve 8 with this agitating member 10. When the toner T is taken in by the developing sleeve 8, a layer thickness of the toner T is regulated by the developing blade 11, and simultaneously the toner T is charged due to friction, and then fed to a developing region 31. Furthermore, toner not contributed to development is moved to the upper side of the developing blade in association with the rotation of the developing sleeve 8, and returned to the developing container 3*a*. The developing blade 11 is an elastic blade made of e.g., urethane rubber, and brought into contact with the developing sleeve 8 under a predetermined pressure, to provide an electric charge necessary for development to toner T and to regulate the layer thickness of toner on the developing sleeve 8.

Toner T is made to adhere to an electrostatic latent image on the photosensitive drum 1 in the developing region 31 to develop this image as a toner image. In the developing sleeve 8, a magnet roller 8*a* in which a plurality of magnetic poles N and S, being a magnetic field generating unit are alternately formed, is arranged in an immobilized manner with respect to the developing sleeve 8. The magnet roller 8*a* makes no rotational movement, held in a constant position at all times, and kept in the same polar direction.

In this embodiment, as toner T, as described above, a mono-component magnetic developer is used to make a reversal development. A developing bias in which a direct current DC is superimposed on an alternating current AC is applied from a developing bias power supply 80 (FIG. 3) to the developing sleeve 8. With this developing bias, the toner T fed into the developing region 31 flies from the developing sleeve 8 onto the photosensitive drum 1. In this embodiment, as a developing bias, a rectangular wave with a DC voltage Vdc=−400 V, an AC voltage of Vpp=1400 V, and frequency of 2000 Hz is used.

A transfer roller 4 as a transfer unit is contacted with the photosensitive drum 1 surface under a predetermined pressure force to form a transfer nip portion N, and is appliedwith a transfer bias from a transfer bias power supply (not shown). With this transfer bias, toner images on the photosensitive drum 1 surface are transferred to recording sheets P, such as papers, at the transfer nip portion N between the photosensitive drum 1 and the transfer roller 4.

The fixing device 7 includes a heating roller provided with a halogen heater (not shown) in an internal part and a pressure roller. While a recording sheet P is being sandwiched and conveyed at the fixing nip between the fixing roller and the pressure roller, a toner image having been transferred onto the surface of the recording sheet P is heated, fused, and pressed to be heat-fixed, thus to be a permanent image. The permanent image on the recording sheet P of which fixing is ended is discharged outside of the image forming apparatus 12.

The cleaning blade 5*a* as a cleaning unit cleans toner not having been transferred onto the photosensitive drum 1 and remaining, and the photosensitive drum 1 is ready again for image formation.

The process cartridge 13 is filled with toner of 500 g in this embodiment, and has a product life of 10,000 sheets at a coverage rate of 4% printing of A4 papers.

<Description of Toner Remaining Amount Detection>

Now, a developer remaining amount detecting unit 17 utilizing the change of capacitance values for use in this embodiment is described referring to FIGS. 2A to 8B.

In this embodiment, a developer (toner) remaining amount detecting unit 17 includes an antenna member 14 as a developer (toner) remaining amount detecting member that is a detecting electrode. In this embodiment, the antenna member 14 is a metal plate (hereinafter sometimes referred to as "PA metal plate") provided throughout the longitudinal region in a position opposite to the developing sleeve 8, and detects toner remaining amount with capacitance between the developing sleeve 8 and the PA metal plate 14.

To detect the remaining amount of toner with high accuracy, a difference Δ between the capacitance (ΔE illustrated in FIG. 4A) measured in the state in which toner T is sufficiently filled in the developing container 3*a* that is in the full state, and the capacitance measured in the state in which the remaining amount of toner T is decreased to be incapable of obtaining good images (hereinafter merely referred to as "blank area"), is desired to be sufficiently large.

Figure 4A:
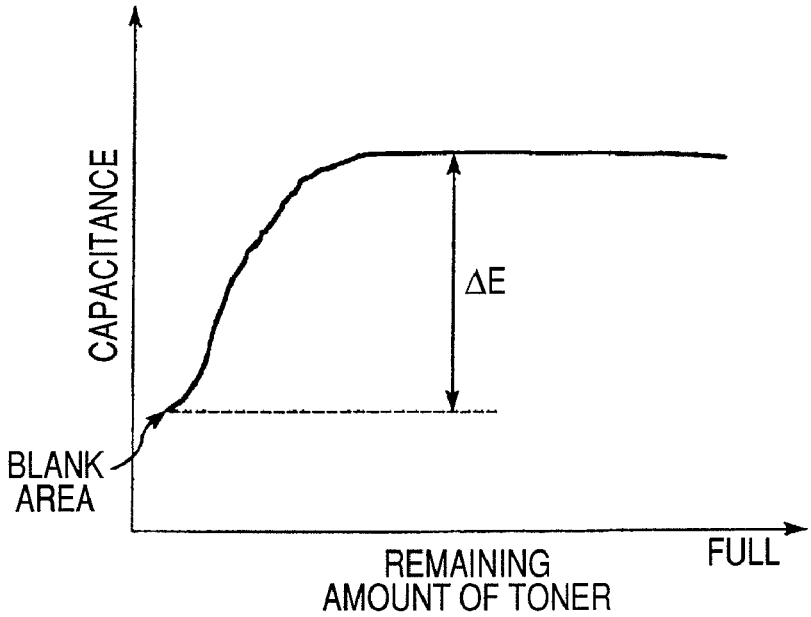
FIG. 4A is a graph diagram illustrating a relation between the remaining amount of toner and a capacitance value in a developer remaining amount detecting unit.
Figure 4B:
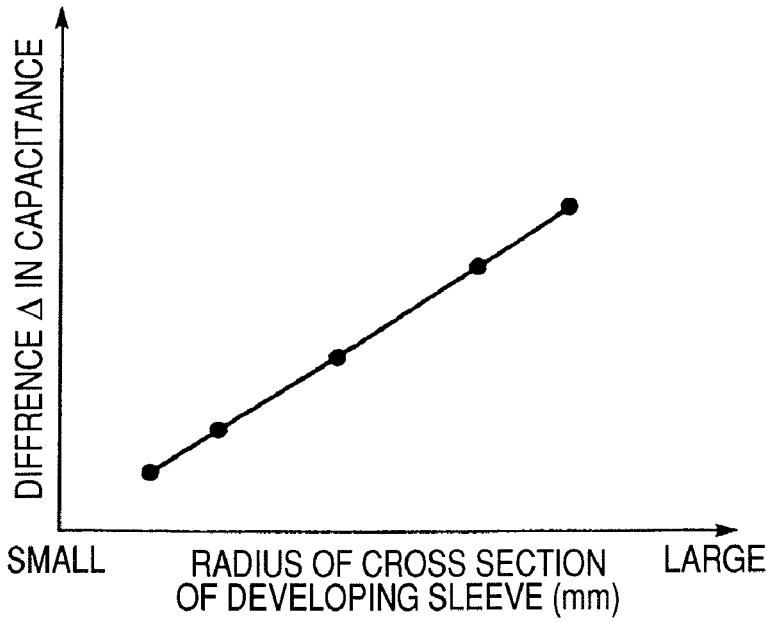
FIG. 4B is a graph diagram illustrating a relation between the radius of cross section of a developing sleeve and a difference Δ in capacitance.

However, as understood in the relation between a radius of a cross section of the developing sleeve 8 and the difference Δ in capacitance illustrated in FIG. 4B, the difference Δ in capacitance becomes be smaller as the radius of cross section of the developing sleeve 8 becomes smaller.

That is, with the developing sleeve 8 of the radius of cross section of 6 mm, which is employed in this embodiment, the difference Δ in capacitance becomes small, and therefore high accuracy of toner remaining amount detection is hard to achieve.

Then, this embodiment is characterized in that toner remaining amount detection is made based on the amount of change per a unit number of revolutions of the agitating member 10 (hereinafter referred to as "rate of change") of a difference between the maximum value and the minimum value of capacitances changing periodically in association with the rotation of the agitating member 10 (hereinafter referred to as "band of fluctuation"). Incidentally, the unit number of revolutions (also referred to as a unit revolution number) may be one revolution or may be a plurality of revolutions.

First, the band of fluctuation and the rate of change to be used in the present invention will be described.

Capacitance values periodically change, with toner states in the developing container 3*a* changing by the rotation of the agitating member 10. This period changes as same as the period of rotation of the agitating member 10. In this embodiment, since the agitating member 10 makes rotation in a period of 10 seconds, the capacitance changes in a period of 10 seconds.

Figure 5A:
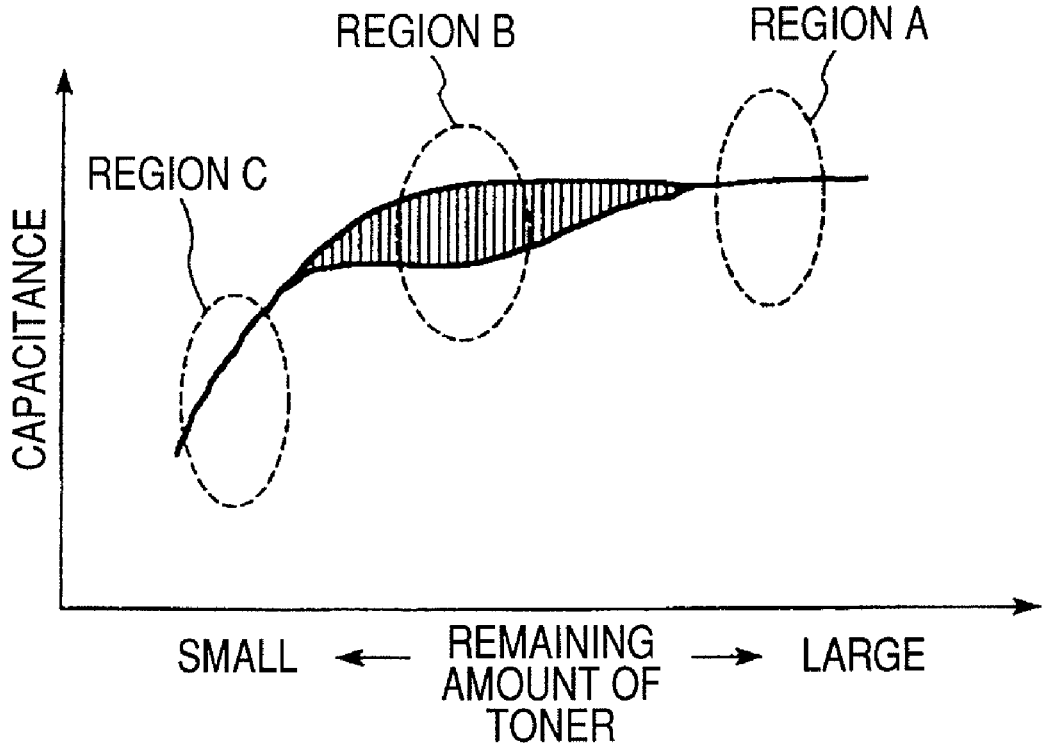
FIGS. 5A and 5B are graph diagram illustrating a relation between the remaining amount of toner and fluctuation in capacitance.
Figure 5B:
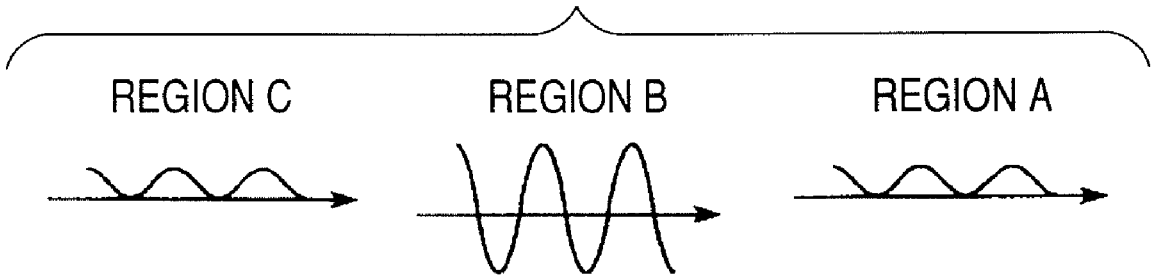

In addition, as illustrated in FIG. 5A, the band of fluctuation changes depending on the remaining amount of toner. This band of fluctuation transits in sequence of region A, region B, and region C as illustrated in FIG. 5B with respect to the remaining amount of toner. The reason thereof is as follows.

Figure 6A:
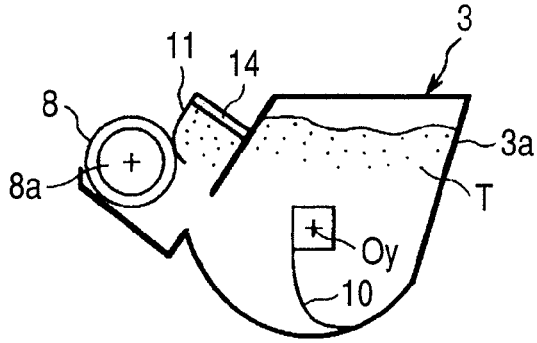
FIGS. 6A, 6B, 6C, and 6D are schematic cross-sectional views illustrating toner and the movement of agitation in the developing device.
Figure 6B:
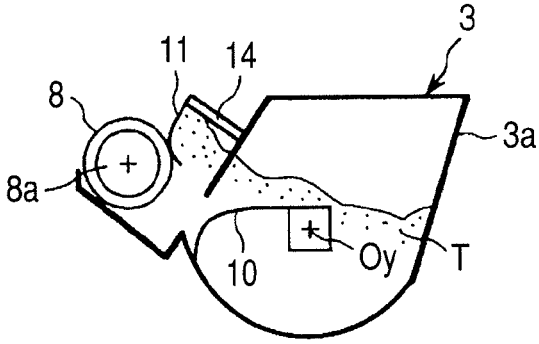
Figure 6C:
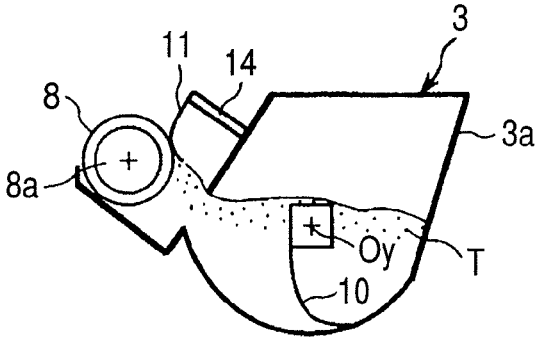
Figure 6D:
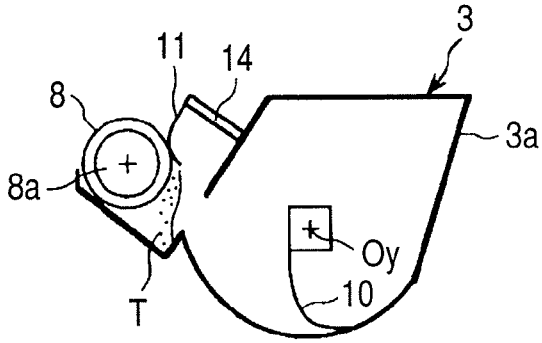

In the range of sufficiently large remaining amount of toner as illustrated in FIG. 6A (in region A of FIG. 5A), the band of fluctuation is hardly detected. However, as in FIGS. 6B and 6C, in the range in which a space is generated between the developing sleeve 8 and the PA metal plate 14 (in region B of FIG. 5A), capacitance values are largely fluctuated in an agitation period, and the band of fluctuation also becomes larger. Furthermore, when the remaining amount of toner becomes small as in FIG. 6D (in region C of FIG. 5A), there are no effects of the agitating member 10, and the band of fluctuation is converged again.

Thus, the band of fluctuation will be transited as illustrated in FIG. 5B.

In addition, the remaining amount of toner when this band of fluctuation begins to appear, the remaining amount of toner when the band of fluctuation becomes the maximum, and the remaining amount of toner when the band of fluctuation is converged, are determined by the positional relation between the developing sleeve 8 and the PA metal plate 14.

As a result of inspection using a plurality of process cartridges made by the present inventors, the relation between the position of the band of fluctuation beginning to appear, the maximum position and the position of being converged, and the remaining amount of toner is hardly changed, to be constant.

Figure 7:
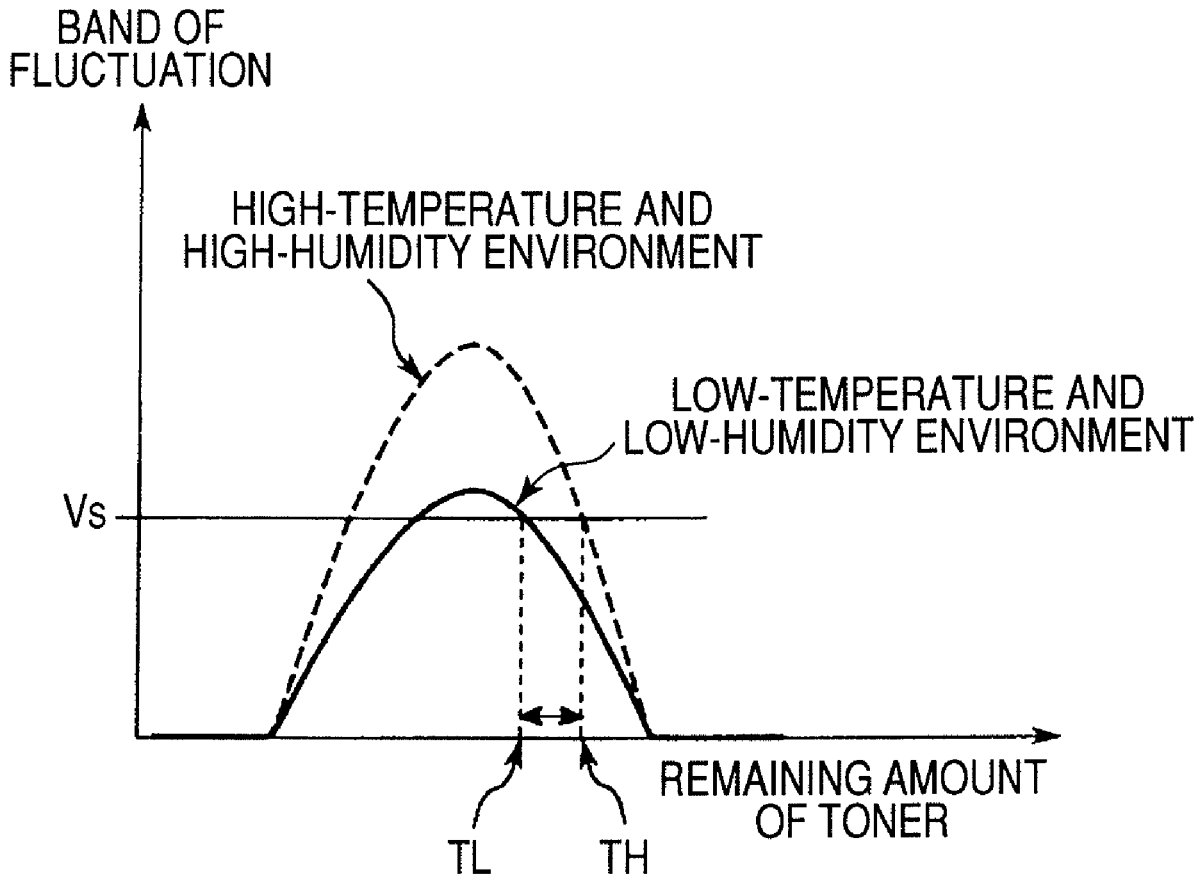
FIG. 7 is a chart illustrating a relation between the remaining amount of toner and the band of fluctuation.

However, as shown in FIG. 7, the maximum values of the band of fluctuation are different depending on the use environment. Therefore, even in the cases of the same band of fluctuation Vs in FIG. 7, there are some cases where the actual remaining amounts of toner are so different as a toner remaining amount TH at high-temperature and high-humidity environment, and a toner remaining amount TL at low-temperature and low-humidity environment. Thus, errors arise upon detecting that the remaining amount of toner becomes small, that is making a toner LOW detection.

Figure 8A:
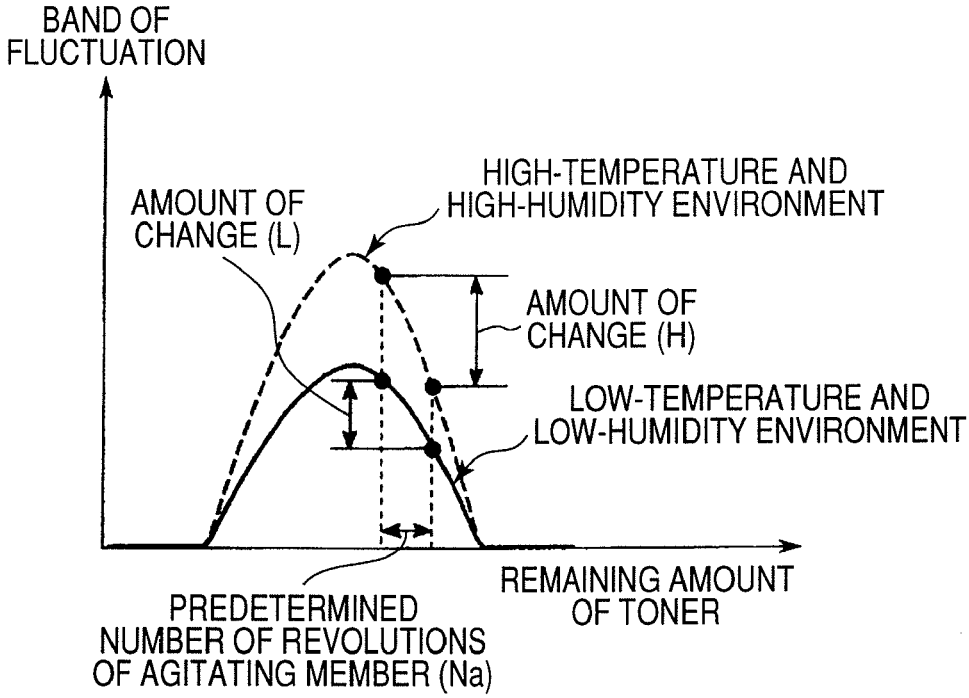
FIG. 8A is a diagram illustrating the remaining amount of toner and the band of fluctuation applied to the present invention.
Figure 8B:
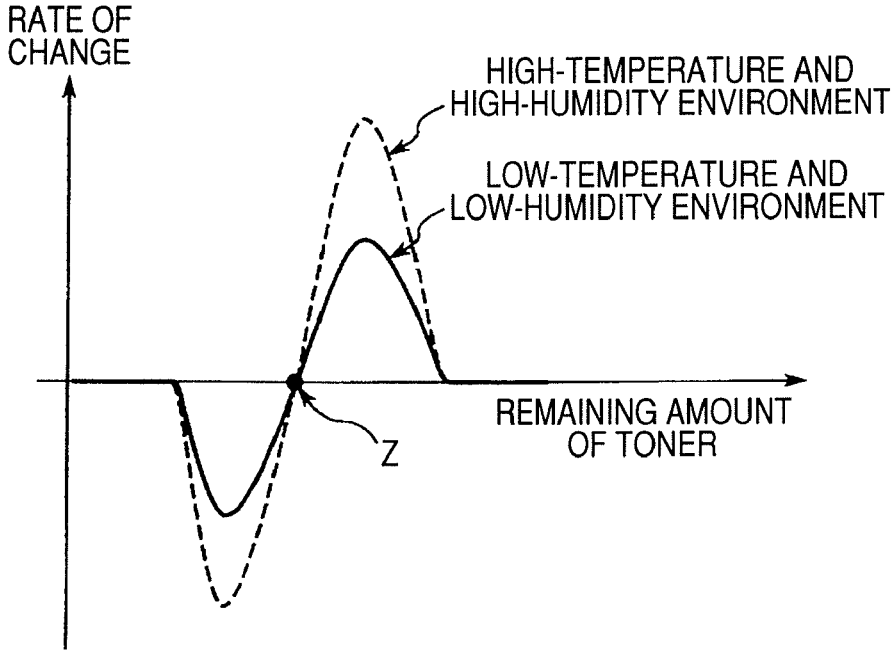
FIG. 8B is a diagram illustrating a relation between the remaining amount of toner and the rate of change.

Then, in this embodiment, as illustrated in FIG. 8A, (the amount of change (H) and the amount of change (L) in FIG. 8A) of the band of fluctuation per a predetermined number of revolutions Na of an agitating member 10 are obtained, and with the rate of change obtained by dividing this amount of change by the number of revolutions Na, a toner LOW detection is made. The transit of the rates of change is as in FIG. 8B. As illustrated in FIG. 8B, the remaining amount of toner Z when the rate of change becomes zero is not affected by the use environment. Accordingly, the accuracy of toner LOW detection can be improved.

Now, the positional relation between a developing sleeve 8 and a PA metal plate 14 according to this embodiment is described again referring to FIGS. 2A and 2B.

Figure 2A:
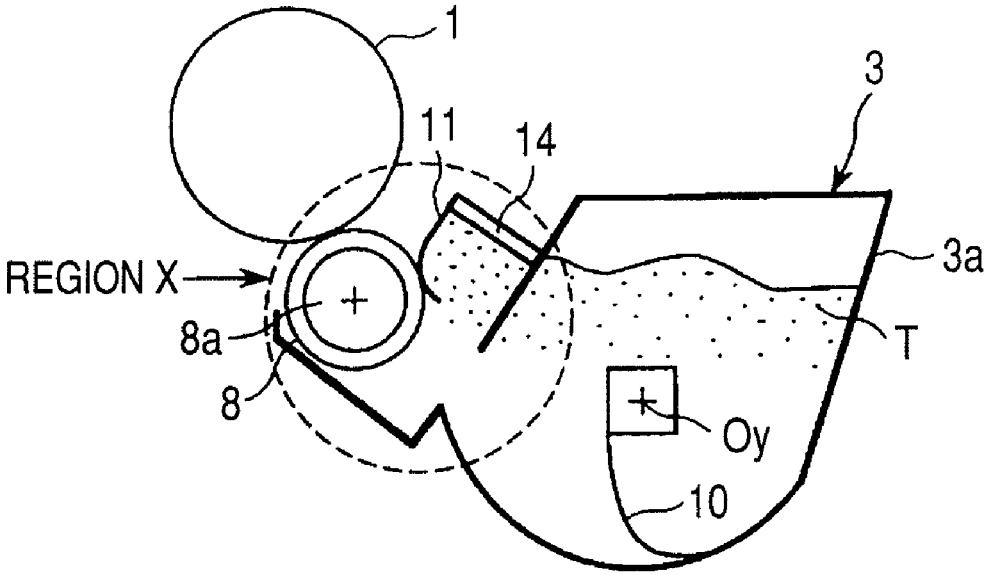
FIGS. 2A and 2B are schematic cross-sectional configuration diagrams of one embodiment of a developing device to which the present invention is applicable.
Figure 2B:
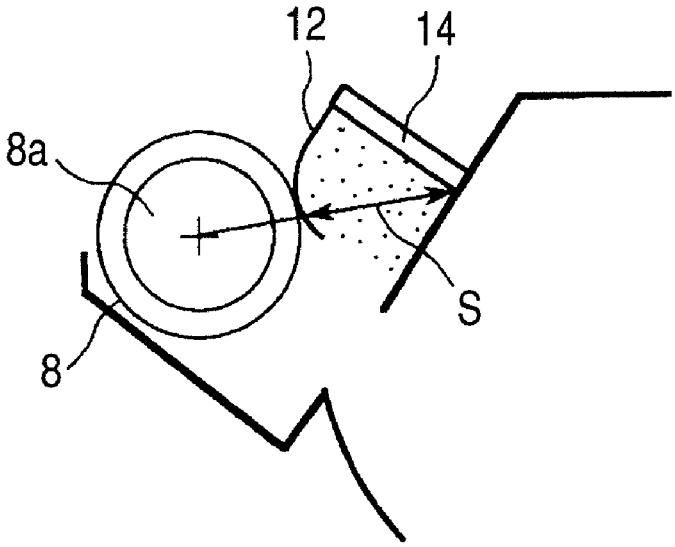

In this embodiment, the PA metal plate 14, as illustrated in FIGS. 2A and 2B, is disposed vertically over the center of rotation Oy of the agitating member 10. Whereby, toner can surely come in or move out of the space between the developing sleeve 8 and the PA metal plate 14.

Furthermore, as illustrated in FIG. 2B, being an enlarged view of region X in FIG. 2A, when the distance S between the surface of the developing sleeve 8 and the remotest portion of the PA metal plate 14 is more than 15 mm, the band of fluctuation Δ in capacitance in association with the rotation of the agitating member 10 becomes small in the case of small areas of the PA metal plate 14; and the detected values of capacitance become unstable even in the case of sufficiently large areas of the PA metal plate 14. Thus, this distance S of more than 15 mm is unfavorable. On the other hand, in a case where the distance between the surface of the developing sleeve 8 and the remotest portion of the PA metal plate 14 is less than 3 mm, there can be formed image with blank areas before capacitance values change.

Thus, from the viewpoint of obtaining high accuracy of a toner remaining amount detection, the PA metal plate 14 is desired to be disposed vertically over the center of rotation Oy of the agitating member 10, and to be 3 mm≦S≦15 mm in distance S of the remotest portion thereof from the surface of the developing sleeve 8.

Then, in this embodiment, a distance S is set to be 12 mm, and the rate of change is set to be 0 (zero) when the remaining amount of toner is 20%.

Furthermore, in the antenna member 14, by selecting a plate-like member such as the above-mentioned PA metal plate, the above-described band of fluctuation Δ of capacitances can be larger than the case of selecting a rod-like antenna member. In particular, the plate-like antenna member is advantageous in a developing device employing a developing sleeve 8 of small radius of cross section as in this embodiment.

As the material of antenna member 14, basically any material in which current can flow may be used without particular limitation. In this embodiment, an SUS plate (SUS 316-CP) is used as the material of the PA metal plate, being the antenna member 14.

<Description of Toner Remaining Amount Detecting Circuit>

Now, one example of a developer (toner) remaining amount detecting unit for use in this embodiment is described.

Figure 3:
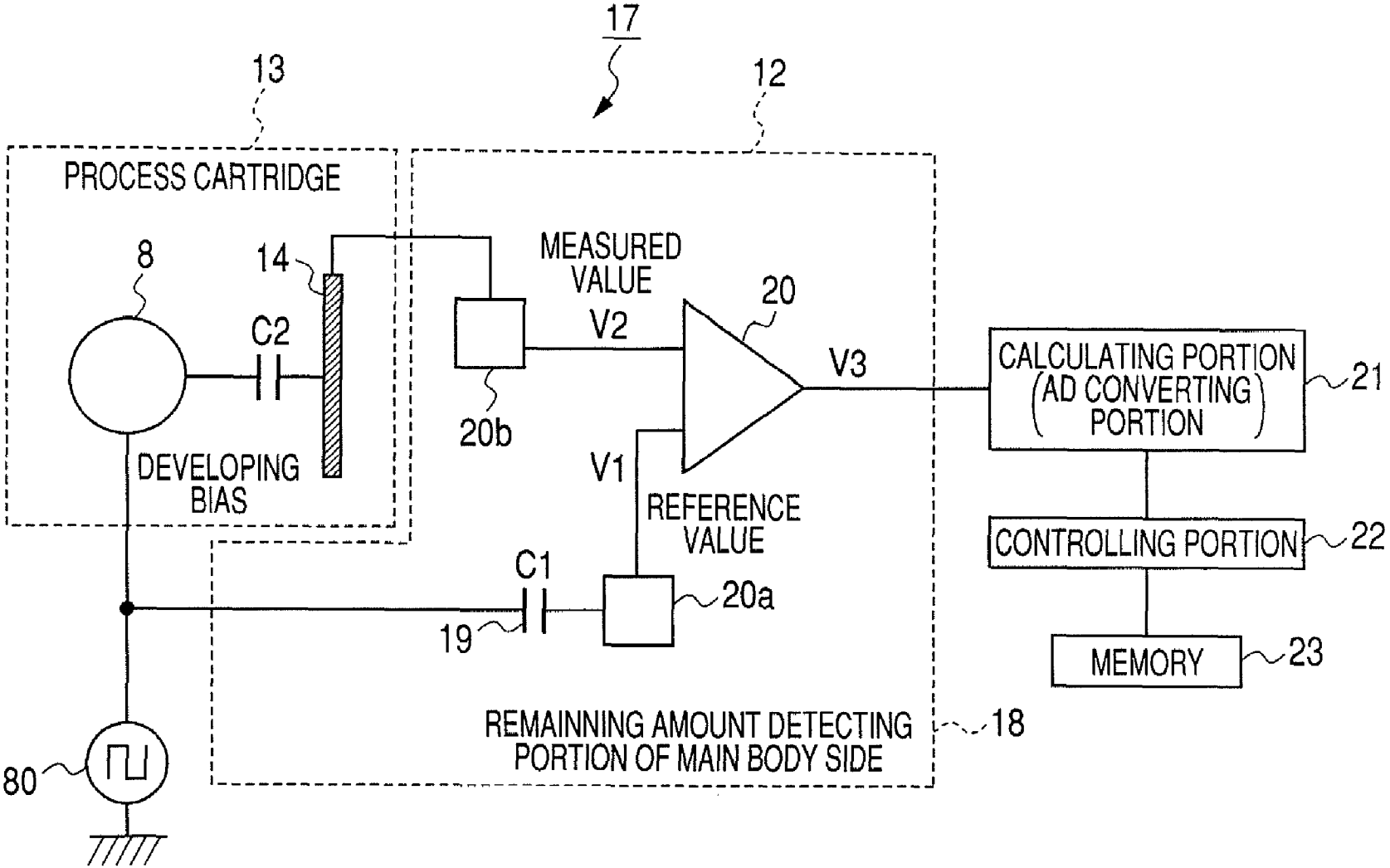
FIG. 3 is a block diagram illustrating one embodiment of a developer remaining amount detecting circuit.

FIG. 3 illustrates a toner remaining amount detecting circuit arrangement forming a toner remaining amount detecting unit 17 for detecting the remaining amount of toner in a process cartridge. A remaining amount detecting portion of main body side 18 forming a toner remaining amount detecting circuit of the toner remaining amount detecting unit 17 is provided at the apparatus main body. Voltage values obtained based on the capacitances between an antenna member that is a PA metal plate 14 and a developing sleeve 8 are output.

To describe further, FIG. 3 illustrates a circuit arrangement of the toner remaining amount detecting portion 18 in the image forming apparatus 12 when the process cartridge 13 is normally mounted onto the image forming apparatus 12.

There are provided electrical contacts (not shown) at the image forming apparatus 12 and the process cartridge 13. Upon the process cartridge 13 being mounted onto the image forming apparatus 12, the PA metal plate 14 and the toner remaining amount detecting portion 18 in the image forming apparatus 12 are electrically connected.

The main body controller 26 includes a remaining amount detecting portion 18, a calculating portion 21, a controlling portion 22, and a main body-side memory 23. The main body controller 26 forms a controlling unit for calculating remaining amounts of toner that are estimated from detected values detected on the cartridge 13 side.

When a predetermined AC bias is output from a developing bias power supply 80 acting as developing bias application unit, this application bias is applied to each of a reference capacitor 19 (capacitance C1; fixed value) and a developing sleeve 8. Whereby, a voltage V1 is generated between the both ends of the reference capacitor 19. Then, a voltage V2 is generated with respect to the capacitance between the developing sleeve 8 and the PA metal plate 14 (capacitance C2; variable depending on the remaining amount of toner).

The detecting circuit (comparator) 20 generates a voltage V3, being a measured value from a voltage difference between these voltages V1 and V2, and outputs this voltage V3 to an AD converting portion 21. The AD converting portion 21 outputs results obtained by digital conversion of the analog voltage V3. The controlling portion 22 calculates the amount of developer in the process cartridge to be estimated from this voltage value V having been converted to a digital value (hereinafter, this value is referred to as "detected value", and its unit is V). Since measurement is made using a developing bias, measurement of remaining amounts of toner is also made simultaneously in the developing process.

As described above, detected values having been detected by the toner remaining amount detecting portion 18 are converted to voltages at the controlling portion 22 of the image forming apparatus main body, and output. This embodiment is arranged such that detected voltage values become larger as the remaining amounts of toner become smaller (capacitance values C2 become smaller). With this toner remaining amount detecting unit 17, the image forming apparatus 12 sequentially detects the remaining amount thereof corresponding to the consumption of toner T in the developing container 3*a*.

This embodiment employs a toner near end method in which detected values do not largely change up to a region A of FIG. 5A, and a sequential detection of toner remaining amounts can be done from a time point at which the remaining amount of toner becomes rather small, that is from a region B.

As described above, in this embodiment, a superimposed bias of an AC bias of 1400 Vpp and 2000 Hz and a DC bias of −400 V, being a developing bias is applied to the developing sleeve 8. Then, an alternating current flows between this developing sleeve 8 and the antenna member 14 in opposition, current values are measured by current measuring devices 20*a* and 20*b*, and further converted to voltage values (V1 and V2).

In this manner, from these measured current values measured by the current measuring devices 20*a* and 20*b*, voltage values, being remaining amount signals based on capacitances between the developing sleeve 8 and the antenna member 14, are detected.

That is, a PA metal plate being an antenna member 14 is arranged in a developing device, and capacitances between the developing sleeve 8 and the PA metal plate 14 are measured, thereby enabling to know the remaining amounts of toner in the developing container 3*a*.

<Toner Remaining Amount Calculation>

Figure 9:
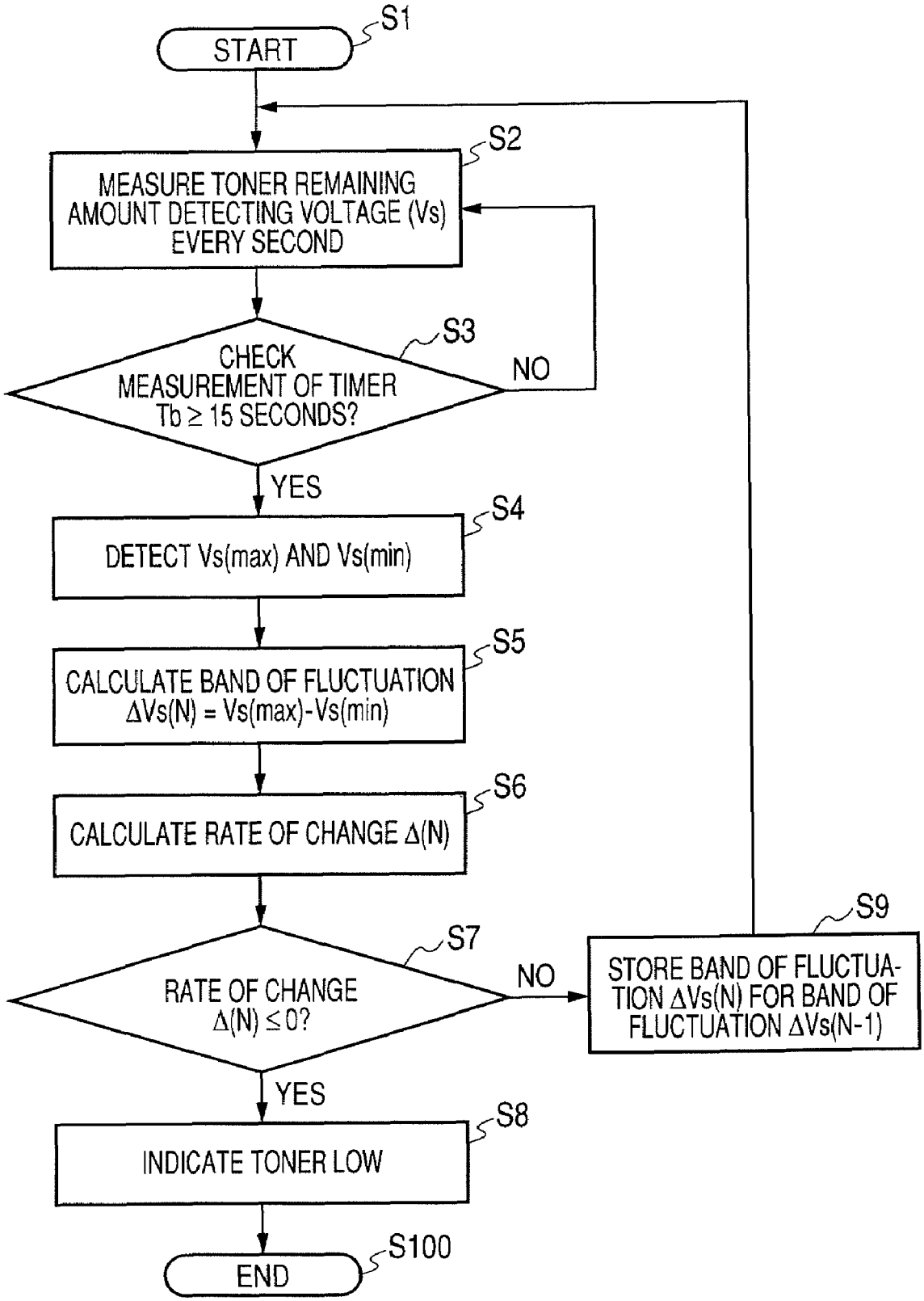
FIG. 9 is a flowchart showing toner remaining amount detecting operation in a first embodiment of the present invention.

Herein, the toner remaining amount detecting method according to this embodiment is described using a flowchart of FIG. 9.

First, when a power supply is turned on, the toner remaining amount detecting control is started (Step S1).

A toner remaining amount detecting voltage Vs is detected every second (Step S2) in this embodiment. Then, whether or not the measured value Tb of a timer exceeds a predetermined value (15 seconds in this embodiment) is determined (Step S3). Since an agitating member makes one revolution in a period of 10 seconds in this embodiment, the measured value Tb of the timer is set to be 15 seconds.

In the case where the measured value Tb of the timer is less than 15 seconds, the process returns to Step S2. While, in the case where the measured value Tb of the timer exceeds 15 seconds, the maximum value Vs (max) and the minimum value Vs (min) are detected from the read Vs (Step S4).

Herein, due to that the period of fluctuation of detected voltage Vs is 10 seconds, the period of measurement is made longer than that of fluctuation of detected voltages Vs like this. Whereby, the maximum value and the minimum value of detected voltages Vs that periodically fluctuate between the maximum value Vs (max) and the minimum value Vs (min) of toner remaining amount detecting voltages Vs can be obtained.

Next, the band of fluctuation ΔVs is calculated from the maximum value Vs (max) and the minimum value Vs (min) (Step S5) to be the Nth band of fluctuation ΔVs (N). Further, the rate of change Δ(N), being a difference between the band of fluctuation ΔVs (N) and the band of fluctuation ΔVs (N−1) stored for the (N−1)th band of fluctuation is calculated (Step S6). That is, herein the rate of change Δ(N) is to be the amount of change in the band of fluctuation ΔVs per one revolution of an agitating member 10. Accordingly, for example, in the case where the rate of change Δ(N') is obtained from the Nth band of fluctuation ΔVs(N) and the band of fluctuation ΔVs(N−2) stored for the (N−2)th band of fluctuation, it may be obtained by calculating (ΔVs(N)−ΔVs(N−2))/2 (revolutions) In addition, the flowchart of FIG. 9 shows the case where the rate of change Δ(N) is obtained from the Nth band of fluctuation ΔVs (N) and the band of fluctuation ΔVs(N−1) stored for the (N−1)th band of fluctuation.

In case where the rate of change is a value smaller than zero in Step S7, toner LOW is indicated on an indicating unit 27 of the main body (Step S8), and then series of processing are ended (Step S100).

In case where the rate of change is a value larger than zero in Step S7, the band of fluctuation ΔVs (N) having been calculated in Step S5 is stored for ΔVs(N−1) (Step S9). Then, the process returns to Step S2, to repeat the same processing.

Figure 10A:
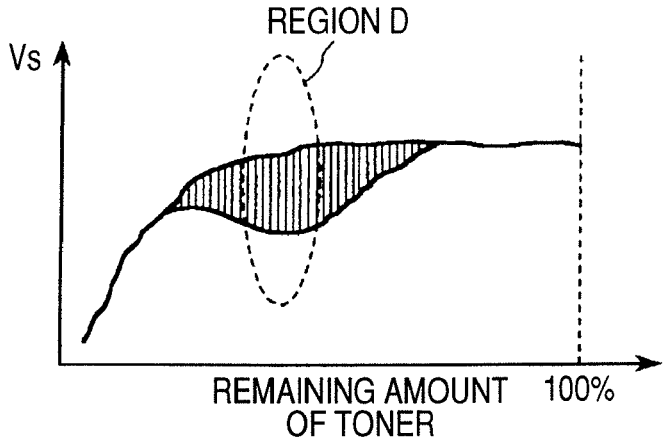
FIGS. 10A and 10B are diagrams illustrating a toner LOW indicating point in the first embodiment of the present invention.
Figure 10B:
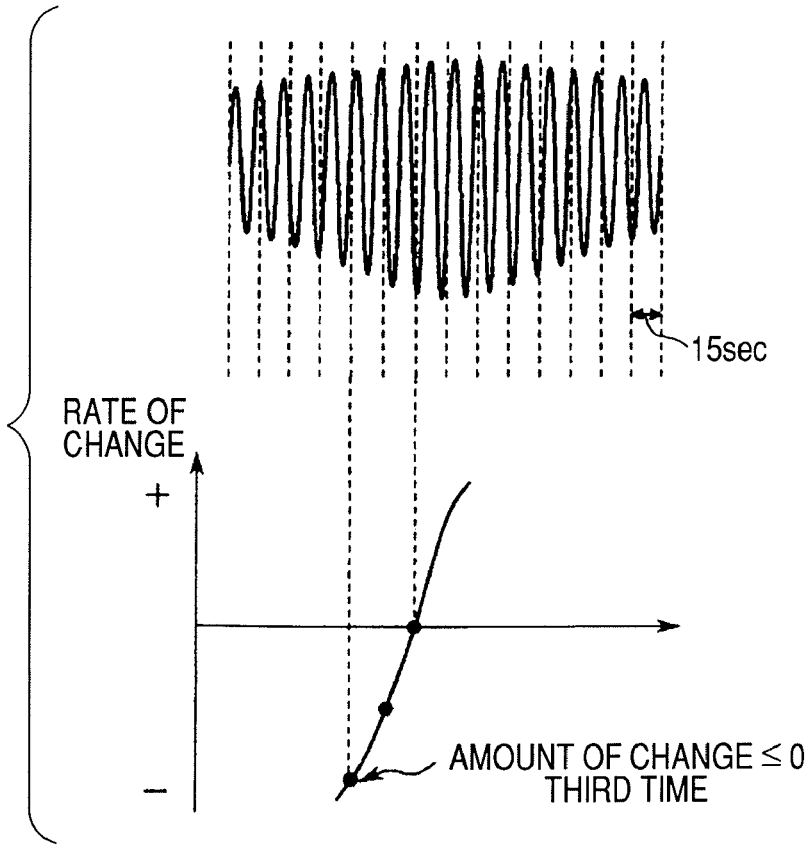

In this embodiment, toner remaining amount output voltages Vs are transited as illustrated in FIG. 1A. Moreover, as understood with an enlarged chart of region D illustrated in FIG. 10B, in this embodiment, at a time point when values of the rate of change of the band of fluctuation have been determined three consecutive times to be not more than zero in Step S7, toner LOW is indicated on the apparatus main body.

Furthermore, in this embodiment, in the case where the step of toner remaining amount detection is stopped in the state in which a measured value Tb of the timer does not reach 15 seconds due to that e.g., printing operation is ended, the measured value Tb of the timer is reset, and the band of fluctuation Vs(N−1) is stored in the memory 23 in the main body control unit 26. At that time, in the case where a value of the rate of change is determined to be not more than zero, the number of times is stored in the memory 23 as well.

Now, print tests were actually made using the process cartridges and the image forming apparatus making a toner remaining amount detection to which a developing device according to this embodiment is applied.

For comparison, print tests were also made using process cartridges and an image forming apparatus to which this embodiment is not applied.

Comparative example 1: an image forming apparatus indicating toner LOW when a capacitance value becomes a predetermined value.

Comparative example 2: an image forming apparatus indicating toner LOW when the band of fluctuation Δ in capacitance in association with the period of an agitating member becomes a predetermined value.

(Conditions)

Sheet Supply Mode: Continuous Endurance at the Coverage Rate of 4%

Evaluation method: An indicating point of toner LOW was set to be the remaining amount of toner of 20%. Letting the remaining amount of toner when an image with blank areas is generated be 0%, from the number of printed sheets A at that time, and the number of printed sheets B at the time of indication of toner LOW, the actual remaining amount of toner at the time of indication of toner LOW was calculated with the following expression (1) and the detection accuracy was evaluated. The evaluation was made by use of respective 50 process cartridges.

The actual remaining amount of toner=100×{1−(number of printed sheets B at the time of an indication of the toner LOW)/(number of printed sheets A at the time of occurrence of a blank area}. Expression 1

(Evaluation Results)

Evaluation results are shown in table 1.

TABLE 1

| Actual Remaining Amount of Toner (%) | Embodiment | Comparative Example 1 | Comparative Example 2 |
|---|---|---|---|
| 0-10 | 0 | 1 | 0 |
| 10-15 | 0 | 0 | 7 |
| 15-20 | 35 | 6 | 11 |
| 20-25 | 12 | 17 | 20 |
| 25-30 | 3 | 5 | 8 |
| 30-50 | 0 | 0 | 4 |
| 50-70 | 0 | 0 | 0 |
| 70-80 | 0 | 11 | 0 |
| 80-90 | 0 | 8 | 0 |
| 90-100 | 0 | 2 | 0 |
| Total | 50 | 50 | 50 |

In the image forming apparatus of comparative example 1 to which this embodiment is not applied, although 29 cases could make toner LOW detection in the range of 10% to 35%, 21 cases made toner LOW detection in its early stages of the actual remaining amount of toner being not less than 70%. The reason thereof may be that detection of the toner remaining amounts is made in the state of toner being unstable in the early stages of its use of process cartridges.

Moreover, in the image forming apparatus of comparative example 2, although no toner LOW detection was made in its early stages of the actual remaining amount of toner being not less than 70%, indication of toner LOW was made in the range where the actual remaining amount of toner is 10% to 50%. These are resulted from that capacitance values of toner are different depending on the environment. That is, fluctuations in detection of toner remaining amounts probably occur due to the fact that remaining amounts of toner are different depending on the environment even if bands of fluctuation Δ are the same.

On the other hand, in the image forming apparatus to which this embodiment is applied, 35 cases made toner LOW detection with high accuracy in the range of the actual remaining amount of toner being 15% to 20%. In all 50 cases, toner LOW indication was made with high accuracy in the range of the actual remaining amount of toner being 15% to 30% not being affected by environments.

Heretofore, as described above, by making the detection of toner remaining amounts based on the rate of change of the band of fluctuation in capacitance accompanied with the period of rotation of an agitating member, detection accuracy of toner LOW could be improved without addition of parts such as a nonvolatile storage unit in a small-sized developing device.

Embodiment 2

Now, a second embodiment according to the present invention will be described.

The basic configuration and operation of an image forming apparatus of this embodiment are the same as those of the first embodiment. Thus, like reference numerals refer to elements having functions and configurations substantially identical or corresponding to those of the image forming apparatus according to the first embodiment, and detailed descriptions of the image forming apparatus and each component will be omitted. Hereinafter, characteristic portions of this embodiment will be described.

This embodiment is characterized in that a nonvolatile storage unit, that is, a memory is provided in a process cartridge, and there are provided two points of toner remaining amount indication.

Figure 11:
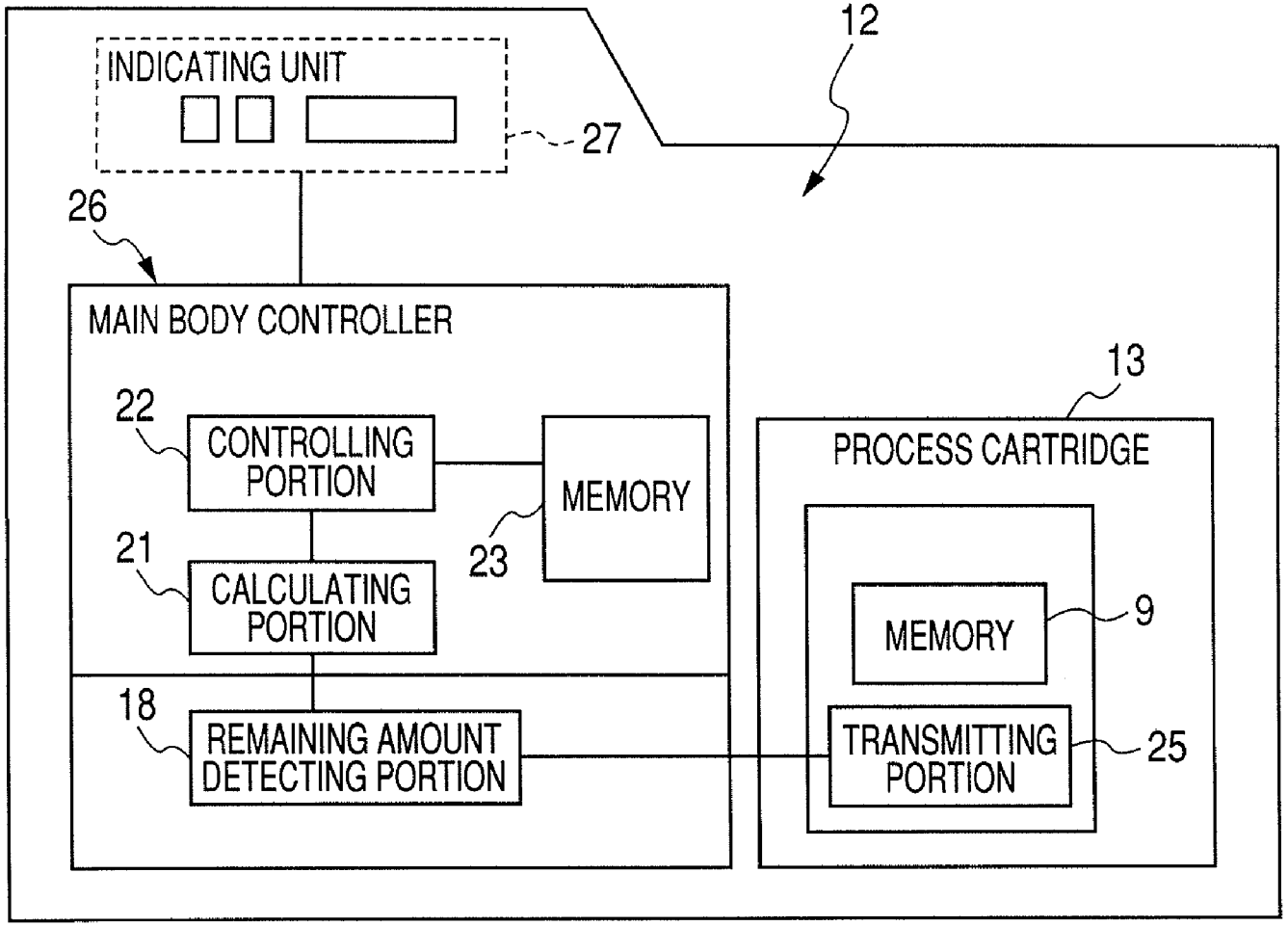
FIG. 11 is a block diagram of a main body controller.

A developing device used in this embodiment is the same as that used in the first embodiment, and a developing sleeve having a radius of 6 mm is used. There is provided a memory 9 in a process cartridge as illustrated in FIG. 11, and information regarding the remaining amount of toner is stored therein. Furthermore, with a controlling unit that is a main body controller 26 provided in an image forming apparatus main body, information regarding the remaining amount of toner is written and updated in the memory 9.

To describe further with reference to FIG. 11, there is provided a storage unit (memory) 9 at a process cartridge 13. In addition, the process cartridge 13 is provided with a transmitting portion 25 on the process cartridge side for controlling the writing and reading of information into and from this memory 9. In the case where the process cartridge 13 is mounted onto the image forming apparatus 12 main body, the cartridge transmitting portion 25 and the main body controller 26 are located opposed to each other. This main body controller 26 also includes functions as a transmitting unit on the main body side.

The main body controller 26 includes a remaining amount detecting portion 18, a calculating portion 21, a controlling portion 22 and a main body side memory 23. The main body controller 26 forms a controlling unit for calculating remaining amounts of toner estimated from detected values having been detected on the cartridge 13 side, and for writing into and reading from information of the cartridge side memory 9.

Although, in this embodiment, a nonvolatile memory of contact type is employed as the memory 9, a non-contact type memory making data communication with an electromagnetic wave, the combination of a volatile memory and a backup power supply, or the like causes no problem.

Figure 12:
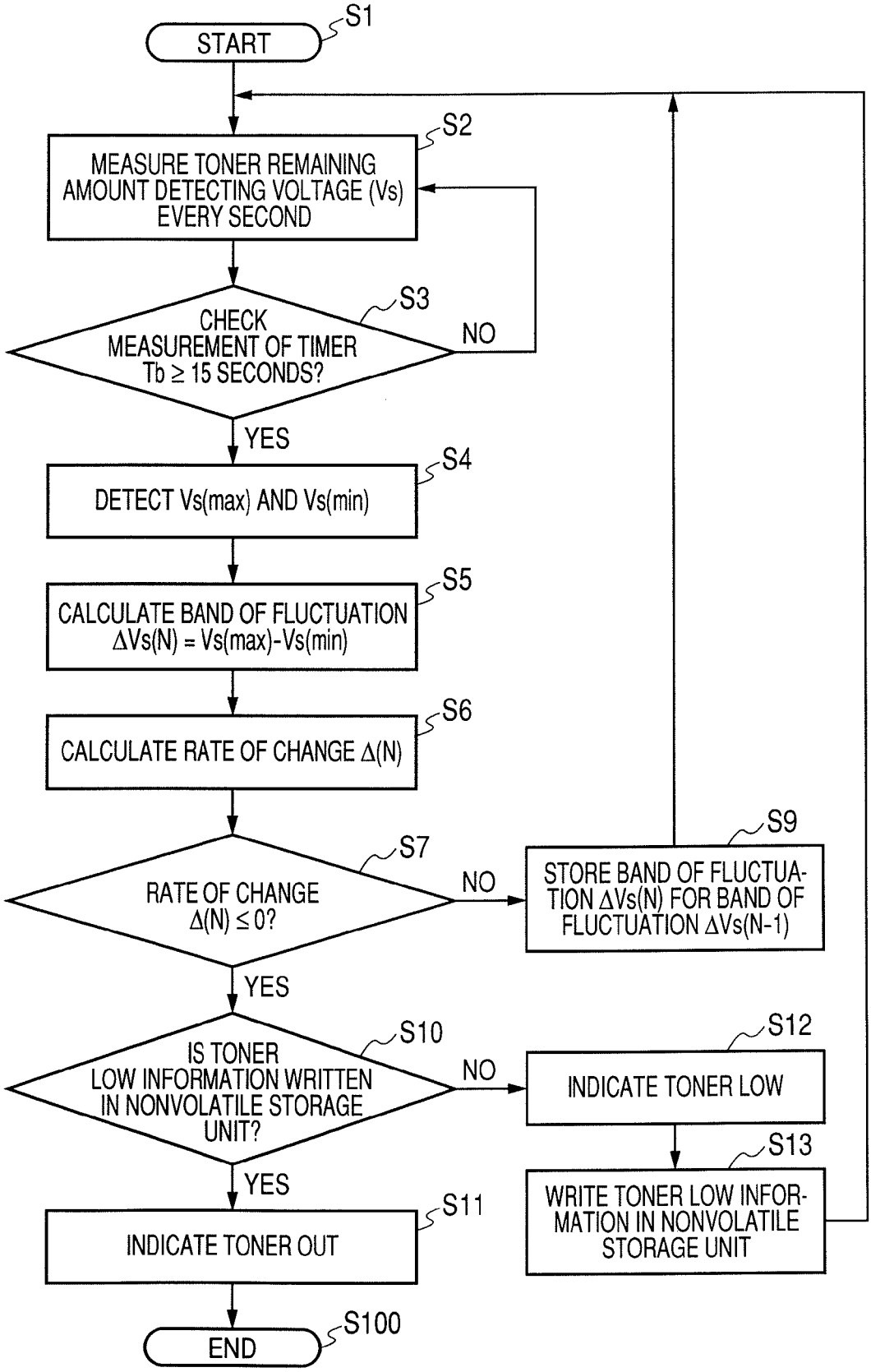
FIG. 12 is a flowchart showing a toner remaining amount detecting operation in a second embodiment of the present invention.

Herein, operations of this embodiment will be described using the flowchart shown in FIG. 12.

In this embodiment, first, when a power supply is turned on, the process starts (Step S1), and the band of fluctuation in an agitation period is obtained (Step S5 through Step S6) as in the first embodiment. Operations in Step S1 through Step S6 are the same as in the first embodiment, so that descriptions thereof will be omitted.

Furthermore, as in the first embodiment, in Step S7, the rate of change $\Delta(N)$=the band of fluctuation $\Delta Vs(N)$−the band of fluctuation $\Delta Vs(N-1)$is calculated from the band of fluctuation, and whether or not the rate of change $\Delta(N) \leqq 0$ is determined. Also herein, the rate of change $\Delta(N)$ is the amount of change of the band of fluctuation $\Delta Vs$ per one revolution of an agitating member 10. Accordingly, in the case where the rate of change $\Delta(N')$ is obtained from the Nth band of fluctuation $\Delta Vs(N)$ and the band of fluctuation $\Delta Vs(N-2)$ stored for the (N−2)th band of fluctuation, $(\Delta Vs(N)-\Delta Vs(N-2))/2$ (revolutions) may be calculated. In addition, the flowchart shown in FIG. 12 shows the case where the rate of change $\Delta(N)$ is obtained from the Nth band of fluctuation $\Delta Vs(N)$ and the band of fluctuation $\Delta Vs(N-1)$ stored for the (N−1)th band of fluctuation.

Subsequently, in this embodiment, in the case of YES in Step S7, it is determined whether or not information showing that toner LOW has already been detected, has already been written in a nonvolatile storage unit (memory) 9 (Step S10). In the case of NO in Step S7, the band of fluctuation $\Delta Vs(N)$ having been calculated in Step S5 is stored for the band of fluctuation $\Delta Vs(N-1)$ (Step S9), and then the process returns to Step S2.

In the case of YES in Step S10, toner OUT is indicated at an indicating unit 27 of the image forming apparatus main body (Step S11), and then the toner remaining amount detection is ended (Step S100). In the case of NO in Step S10, toner LOW is indicated at the indicating unit 27 of the image forming apparatus (Step S12), information regarding that toner LOW has already been detected is written in the memory 9 at the same time (Step S13), and when the process returns to Step S2.

Now, print tests were made using the image forming apparatus according to this embodiment.

In this embodiment, letting the indicating point of toner LOW be 20%, and letting the indicating point of toner OUT be 5%, evaluations of 50 numbers of process cartridges were made under the same conditions as those in the first embodiment.

Results of tests are shown.

TABLE 2

| Actual Remaining Amount of Toner (%) | Toner Out | Toner Low |
|---|---|---|
| 0-5 | 40 | 0 |
| 5-10 | 10 | 0 |
| 10-15 | 0 | 0 |
| 15-20 | 0 | 35 |
| 20-25 | 0 | 10 |
| 25-30 | 0 | 5 |

TABLE 2-continued

| Actual Remaining Amount of Toner (%) | Toner Out | Toner Low |
|---|---|---|
| 30-50 | 0 | 0 |
| 50-70 | 0 | 0 |
| 70-80 | 0 | 0 |
| 80-100 | 0 | 0 |
| Total | 50 | 50 |

All detections could be made with high accuracy with toner OUT indication in the range of 0% to 10%, and with toner LOW indication in the range of 15% to 30%.

As described above, due to that a process cartridge is provided with a nonvolatile storage unit 9, two points of toner remaining amount detection of toner LOW and toner OUT could be indicated with high accuracy in a small-sized image forming apparatus.

Embodiment 3

Figure 13:
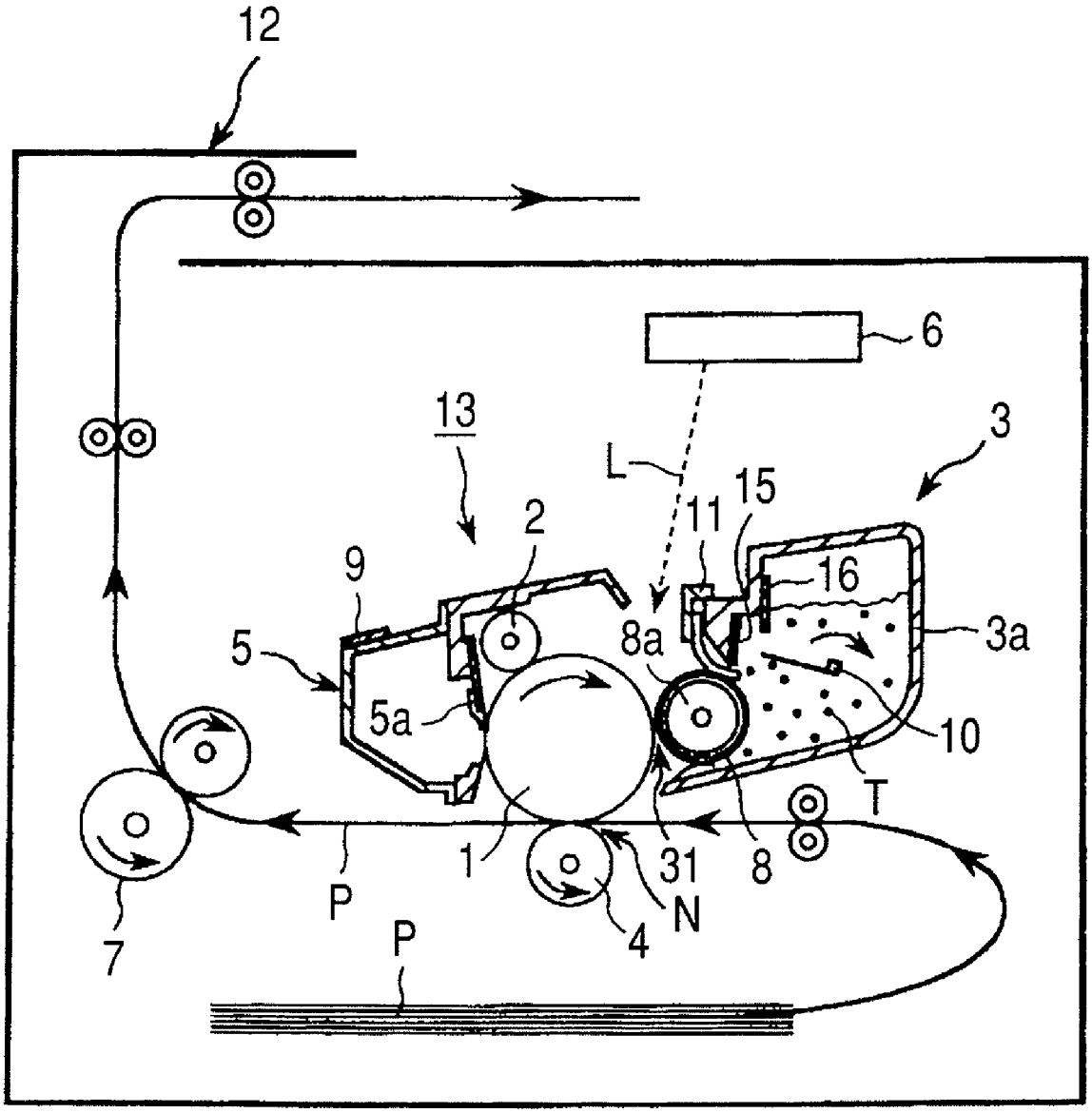
FIG. 13 is a schematic cross-sectional configuration diagram explaining another embodiment of an image forming apparatus according to the present invention.

Now, a third embodiment according to the present invention will be described. FIG. 13 illustrates the schematic configuration of an image forming apparatus according to this embodiment.

The basic configuration and operation of an image forming apparatus of this embodiment are the same as those of the image forming apparatus described in the first embodiment. Thus, like reference numerals refer to elements having functions and configurations substantially identical or corresponding to those of the image forming apparatus according to the first embodiment, and detailed descriptions of the image forming apparatus and each component will be omitted.

FIG. 13 illustrates a schematic configuration of an electrophotographic laser beam printer, being an image forming apparatus according to this embodiment.

An image forming apparatus 12 utilizing an electrophotographic technology according to this embodiment is provided with a drum-shaped electrophotographic photosensitive member (hereinafter referred to as "photosensitive drum") 1 as an image bearing member. Around the photosensitive drum 1, there are arranged in order along the direction of rotation of the photosensitive drum 1 a charging roller 2 as a charging unit, a developing device 3 being a developing unit, a transfer roller 4 as a transfer unit, and a cleaning device 5 as a cleaning unit provided with a cleaning blade 5*a*. Furthermore, an exposure device 6 is arranged above between the charging roller 2 and the developing device 3. A fixing device 7 is arranged on the downstream side of a transfer nip N formed between the photosensitive drum 1 and the transfer roller 4 in a conveying direction of recording sheets.

In this embodiment, out of the above-mentioned components, the photosensitive drum 1, the charging roller 2, the developing device 3, and the cleaning device 5 are configured to be an integral unit, to form a process cartridge 13 detachably mountable to an image forming apparatus main body.

In this embodiment, the photosensitive drum 1 includes an OPC (organic photoconductive) layer on a drum base body made of aluminum, and is driven to rotate in a direction indicated by the arrow (in a clockwise direction) at a predetermined circumferential speed by a driving unit (not shown) provided on the image forming apparatus main body side.

The photosensitive drum 1 is uniformly charged to a negative polarity by the charging roller 2 being in contact with the photosensitive drum 1 in the rotation process of the photosensitive drum 1.

The charging roller 2 as a charging unit uniformly charges the photosensitive drum 1 to a predetermined polarity and electric potential with a charging bias applied from a charging bias power supply (not shown). A charging bias in which a DC voltage Vprdc, which corresponds to a dark section potential Vd on the photosensitive drum, is superimposed on an AC voltage Vpp, which sufficiently electrically discharges the charging roller 2, is applied. An alternating current AC component of the charging bias makes such a constant current control that a constant current is applied all the time between the photosensitive drum 1 and the charging roller 2.

An exposure device 6 outputs from a laser output portion (not shown) image information input from a personal computer (not shown) in the form of a laser beam (exposure beam) modulated in accordance with time-series electric digital image signals by a video controller (not shown). An exposure beam L makes scanning and exposure of the charged photosensitive drum 1 surface, thereby forming an electrostatic latent image corresponding to image information.

The developing device 3 includes a developing container 3*a* as a developer containing portion, and contains a developer T therein. Furthermore, there is disposed in the opening of the developing container 3*a* a developing sleeve 8 acting as a developer carrying member made of a non-magnetic developing member, such as aluminum pipe, which developing sleeve 8 is opposed to the photosensitive drum 1 surface, and is capable of rotating while keeping a predetermined distance therebetween. In addition, in the developing container 3*a*, there are included an agitating member 10 rotatable in a direction indicated by the arrow which agitating member 10 functions to agitate a developer, and a developing blade 11 for frictionally charging a developer on the developing sleeve 8. In this embodiment, a developer T employs a mono-component magnetic developer (toner) of an average particle diameter of 7 μm. Developers are not limited to mono-component magnetic toner.

An agitating member 10 employs a PPS sheet with thickness of 100 μm, and makes one revolution in approximately 3 seconds in this embodiment. Toner T is transported to the developing sleeve 8 with this agitating member 10. Toner T is taken in at the developing sleeve 8. At the time, a layer thickness of the toner T is regulated by the developing blade 11, and simultaneously the toner T is charged due to friction, and then fed to a developing region 31. The developing blade 11 is an elastic blade made of e.g., urethane rubber, and brought in contact with the developing sleeve under a predetermined pressure, to provide an electric charge necessary for development to the toner T and to regulate the layer thickness of the toner on the developing sleeve 8.

The toner T is made to adhere to an electrostatic latent image on the photosensitive drum 1 in the developing region 31 to develop this image as a toner image. In the developing sleeve 8, a magnet roller 8*a* in which a plurality of magnetic poles N and S, being a magnetic field generating unit are alternately formed, is arranged in an immobilized manner with respect to the developing sleeve 8. The magnet roller 8*a* makes no rotational movement, held at a constant position at all times, and kept in the same polar direction.

In this embodiment, as described above, the toner T employs a mono-component magnetic developer to make a reversal development. A developing bias of superimposed direct current DC and alternating current AC is applied from the developing bias power supply 80 (FIG. 15) to the developing sleeve 8. With this developing bias, the toner T having been fed into the developing region 31 flies from the developing sleeve 8 onto the photosensitive drum 1. In this embodiment, a rectangular wave with a DC voltage Vdc=−500V, an AC voltage of Vpp=1500V, and frequency of 2500 Hz was used.

A transfer roller 4 as a transfer unit is contacted with the photosensitive drum 1 surface under a predetermined pressure force to form a transfer nip portion N, and is applied with a transfer bias from a transfer bias power supply (not shown). With this transfer bias, toner images on the photosensitive drum 1 surface are transferred onto recording sheets such as papers at the transfer nip portion N between the photosensitive drum 1 and the transfer roller 4.

The fixing device 7 includes a heating roller provided with a halogen heater (not shown) in an internal part and a pressure roller. While a recording sheet P is being sandwiched and conveyed at the fixing nip between the fixing roller and the pressure roller, a toner image having been transferred onto the surface of the recording sheet P is heated, fused, and pressed to be heat-fixed, thus to be a permanent image. The permanent image on the recording sheet P for which fixing is ended is discharged outside of the image forming apparatus 12.

The cleaning blade 5*a* as a cleaning unit cleans toner not having been transferred onto the photosensitive drum 1 and remaining, and the photosensitive drum 1 is devoted again for image formation.

A process cartridge 13 is filled with toner of 500 g in this embodiment, and has a product life of 10,000 sheets at the coverage rate of 4% printing of A4 papers.

Hereinafter, characteristic portions in this embodiment will be described.

This embodiment is characterized in a configuration that an antenna member being an electrode member as a developer remaining amount detecting member forming a developer (toner) remaining amount detecting unit 17 includes a first antenna member 16 to which a predetermined voltage is applied and a second antenna member 15 outputting signals corresponding to capacitances generated by voltages applied to the first antenna member 16.

Also in this embodiment, as in the first embodiment, the distance between the first antenna member and the second antenna member is set so that the rate of change is substantially 0 (zero) when the remaining amount of a developer in the developing container reaches a predetermined amount.

Next, referring to FIGS. 13 to 16, a toner remaining amount detecting unit 17 utilizing the change of capacitance values which toner remaining amount detecting unit forms characteristic portions of this embodiment will be described.

In the developing device 3 of the process cartridge 13, two parallel metal plates of a plate antenna metal plate (hereinafter referred to as "PA metal plate") 15 and a PA metal plate 16 acting as a developer remaining amount detecting member for detection of developer remaining amounts which developer remaining amount detecting member forms a toner remaining amount detecting unit 17, are fixed and arranged so as to extend in a longitudinal direction in the process cartridge, and opposite to each other.

As described above, a developing bias in which a DC component is superimposed on an AC component is applied to the developing sleeve 8 from the power supply 80 to cause toner to fly to the photosensitive drum 1. The PA metal plate 16 is applied with a remaining amount detecting bias from the same power supply 80 as the developing bias. On that occasion, current values induced at the PA metal plate 15 are measured, and capacitances between the PA metal plates 15 and 16, or between the PA metal plate 15 and the developing sleeve 8 can be measured by a toner remaining amount detecting portion 18.

Toner remaining amounts, since the developing device 3 is in the state of being sufficiently filled with toner in the case of large remaining amounts of toner, can be detected by measuring capacitances between the PA metal plates 15 and 16. Furthermore, in the case of small amounts of toner, there is in the developing device 3 little toner, which is just resided in the vicinity of the developing sleeve 8, so that toner remaining amounts can be detected by measuring capacitances between the PA metal plate 15 and the developing sleeve 8.

The PA metal plate 16 is an input electrode member (first electrode) to which a detected voltage is input in a developer remaining amount detecting unit of the image forming apparatus 12. In addition, the PA metal plate 15 functions as an output electrode member (second electrode) outputting to the image forming apparatus 12 capacitances corresponding to remaining amounts of a developer (toner remaining amounts) resided between the PA metal plate or the developing sleeve 8 and the PA metal plate 15.

The capacitance C between the PA metal plates 15 and 16, being two sheets of electrode members is in relation of the following expression (2) with the area A of the PA metal plates 15 and 16, the distance d therebetween, and the relative permittivity Kϵ between two PA metal plates 15 and 16.

$$C=K\epsilon\times A/d \quad (2)$$

The relative permittivity Kϵ is a value changing corresponding to the amount of toner between PA metal plates. Due to the fact that Kϵ becomes large when there are large amounts of toner between the PA metal plates, and Kϵ becomes small when there are small amounts of toner therebetween, toner remaining amounts and capacitances are related. Thus, the remaining amount of toner is converted with a relative permittivity Kϵ.

In the configuration used in this embodiment, the PA metal plates 15 and 16 employ non-magnetic SUS plates of area A=15 $cm^2$. As in the first embodiment, the distance between the PA metal plates 15 and 16 is set to be 0 (zero) when the rate of change of band of fluctuation in capacitance between the PA metal plates 15 and 16 reaches a predetermined value. In this embodiment, the distance Sa between the developing sleeve 8 and the PA metal plate 15 is 5 mm, and the distance Sb between the PA metal plate 15 and the PA metal plate 16 is 15 mm.

Although in this embodiment, the PA metal plate 15 and the PA metal plate 16 employ a non-magnetic SUS plate (SUS 316-CP), any conductive material can be used without particular limitation.

Figure 14:
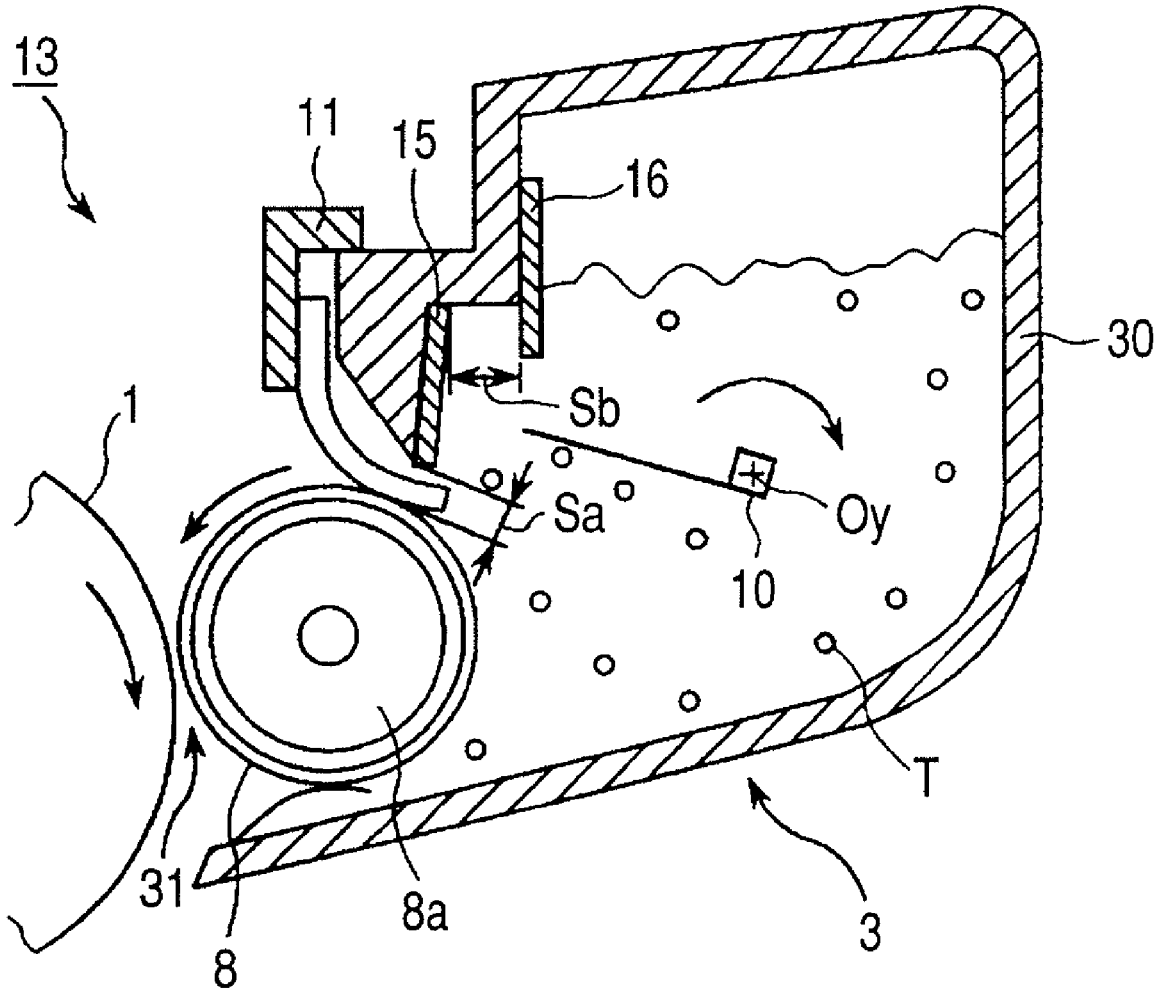
FIG. 14 is a schematic cross-sectional configuration diagram of one embodiment of a developing deice to which the present invention is applicable.

Moreover, in this embodiment, the PA metal plates 15 and 16, as illustrated in FIG. 14, are disposed vertically over the center of rotation Oy of the agitating member 10. Whereby, toner can surely come in or move out of the space between the PA metal plates 15 and 16.

<Description of Toner Remaining Amount Detecting Circuit>

Figure 15:
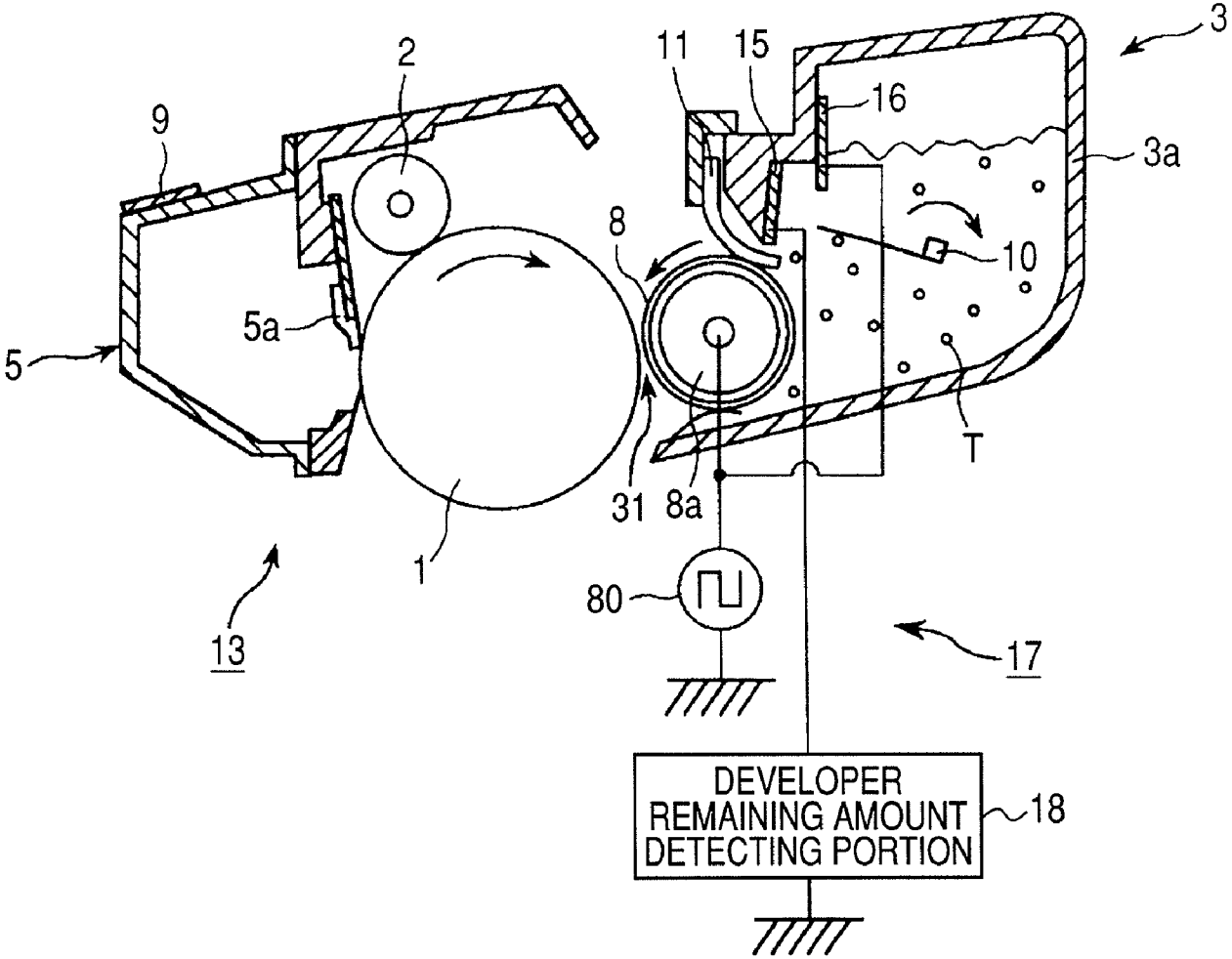
FIG. 15 is a schematic cross-sectional configuration diagram of one embodiment of a process cartridge to which the present invention is applicable.

Next, one example of toner remaining amount detecting circuits for use in this embodiment will be described referring to FIGS. 15 and 16.

Figure 16:
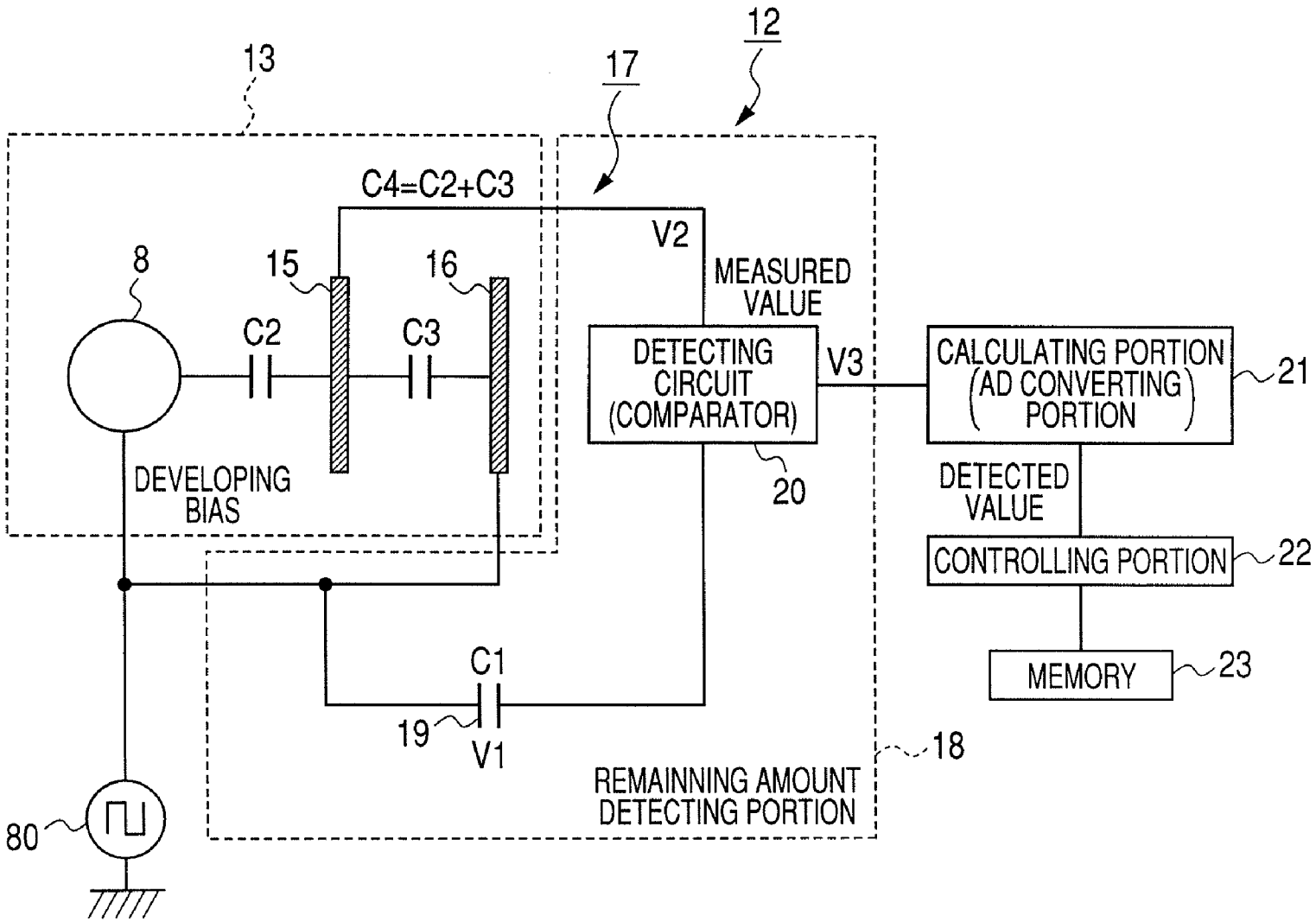
FIG. 16 is a block diagram illustrating another embodiment of a developer remaining amount detecting circuit.

FIG. 16 illustrates a circuit arrangement of a toner remaining amount detecting portion 18 in the image forming apparatus 12 when the cartridge 13 is normally mounted onto the image forming apparatus 12. There are provided electrical contacts (not shown) at the image forming apparatus 12 and the process cartridge 13. When the process cartridge 13 is mounted onto the image forming apparatus 12, the PA metal plates 15 and 16 and the toner remaining amount detecting portion 18 in the image forming apparatus 12 are electrically connected through the electrical contacts.

When a predetermined AC bias is output from the developing bias power supply 80 acting as a developing bias application unit, this application bias is applied to each of a reference capacitor 19 (capacitance C1; fixed value), a developing sleeve 8, and an input PA metal plate 16. Whereby, a voltage V1 is generated across the reference capacitor 19. Further, a voltage V2 is generated with respect to a combined capacitance (C4=C2+C3) of the capacitance between the developing sleeve 8 and the PA metal plate 15 (capacitance C2; variable depending on the remaining amount of toner) and the capacitance between the PA metal plates 15 and 16 (capacitance C3; variable depending on the remaining amount of toner).

The detecting circuit 20 generates a voltage V3, being a measured value from a voltage difference between these voltages V1 and V2, and outputs this voltage V3 to the AD converting portion 21. The AD converting portion 21 outputs results obtained by digital conversion of the analog voltage V3 to the controlling portion 22. The controlling portion 22 calculates the remaining amount of a developer in the process cartridge to be estimated from this voltage value V having been converted to a digital value, that is a detected value (its unit is V). Since measurement is made using a developing bias, remaining amounts of toner are also measured simultaneously in the developing process.

Figure 17:
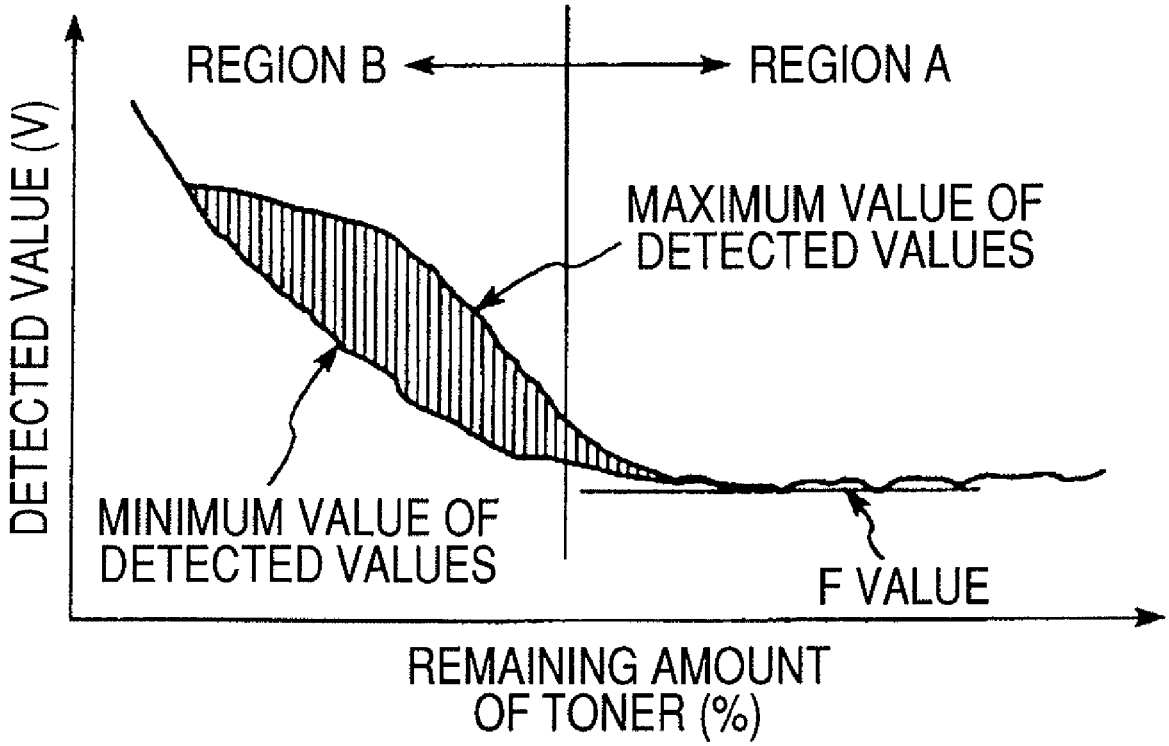
FIG. 17 is a graph diagram illustrating a relation between the remaining amount of toner and fluctuation in capacitance.

As described above, detected values having been detected by the toner remaining amount detecting portion 18 are converted to voltages at the controlling portion 22 of the image forming apparatus main body, and output as voltage values V as illustrated in FIG. 17 in normal cases. This embodiment is arranged such that detected voltage values become larger as remaining amounts of toner are decreased (capacitance values C4 are decreased). By this toner remaining amount detecting mechanism, the image forming apparatus 12 detects the remaining amount thereof in sequence corresponding to the consumption of toner T in the developing container 3*a*.

This embodiment employs the toner near end method in which detected values are not largely fluctuated up to a region A of FIG. 17, and a sequential detection of remaining amounts can be done from a time point at which the remaining amount of toner becomes rather small, that is from a region B.

<Storage Unit (Memory)>

Figure 18:
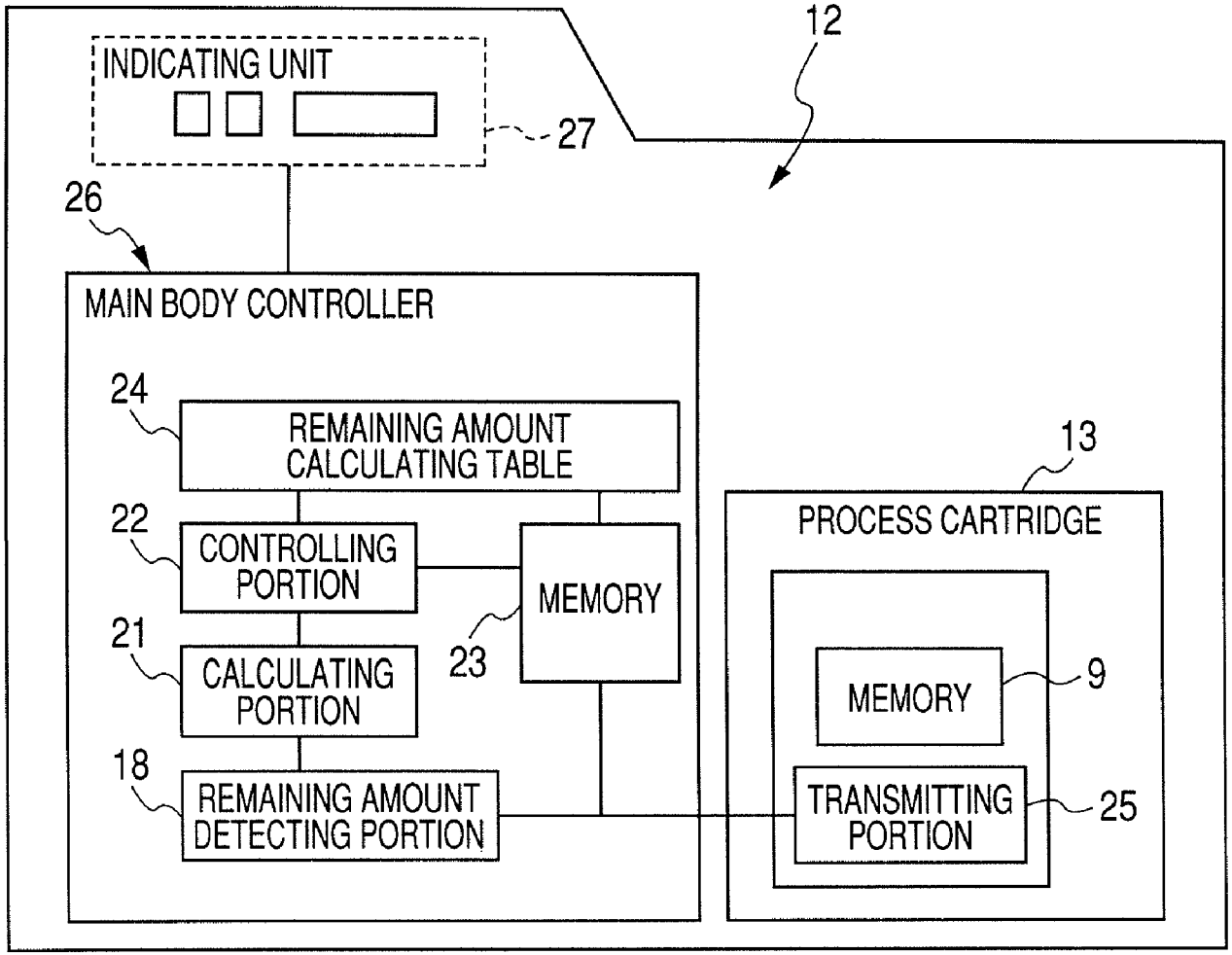
FIG. 18 is a block diagram of another embodiment of a main body controlling portion.

Next, a storage unit will be described referring to FIG. 18.

In this embodiment, there is provided a storage unit (memory) 9 at a process cartridge 13. Further, the process cartridge 13 is provided with a transmitting portion 25 on the process cartridge side for controlling writing and reading of information into and from this memory 9. In the case where the process cartridge 13 is mounted onto the image forming apparatus 12 main body, the cartridge transmitting portion 25 and the main body controller 26 are located opposed to each other. This main body controller 26 also functions as transmitting unit on the main body side.

The main body controller 26 includes a remaining amount detecting portion 18, a calculating portion 21, a controlling portion 22, a main body side memory 23 and a remaining amount calculating table 24. The main body controller 26 forms a controlling unit for calculating the remaining amount of toner estimated from a detected value having been detected on the cartridge 13 side, and for writing information in and retrieving information from the cartridge side memory 9.

Although, in this embodiment, a nonvolatile memory of contact type is employed as a memory 9, a non-contact type memory making data communication with an electromagnetic wave, the combination of a volatile memory and a backup power supply, or the like causes no problem. Information having been written to the memory 9 of the cartridge side is transmitted to the main body side memory 23 at the start of use of a process cartridge 13.

<Toner Remaining Amount Calculation>

Figure 19:
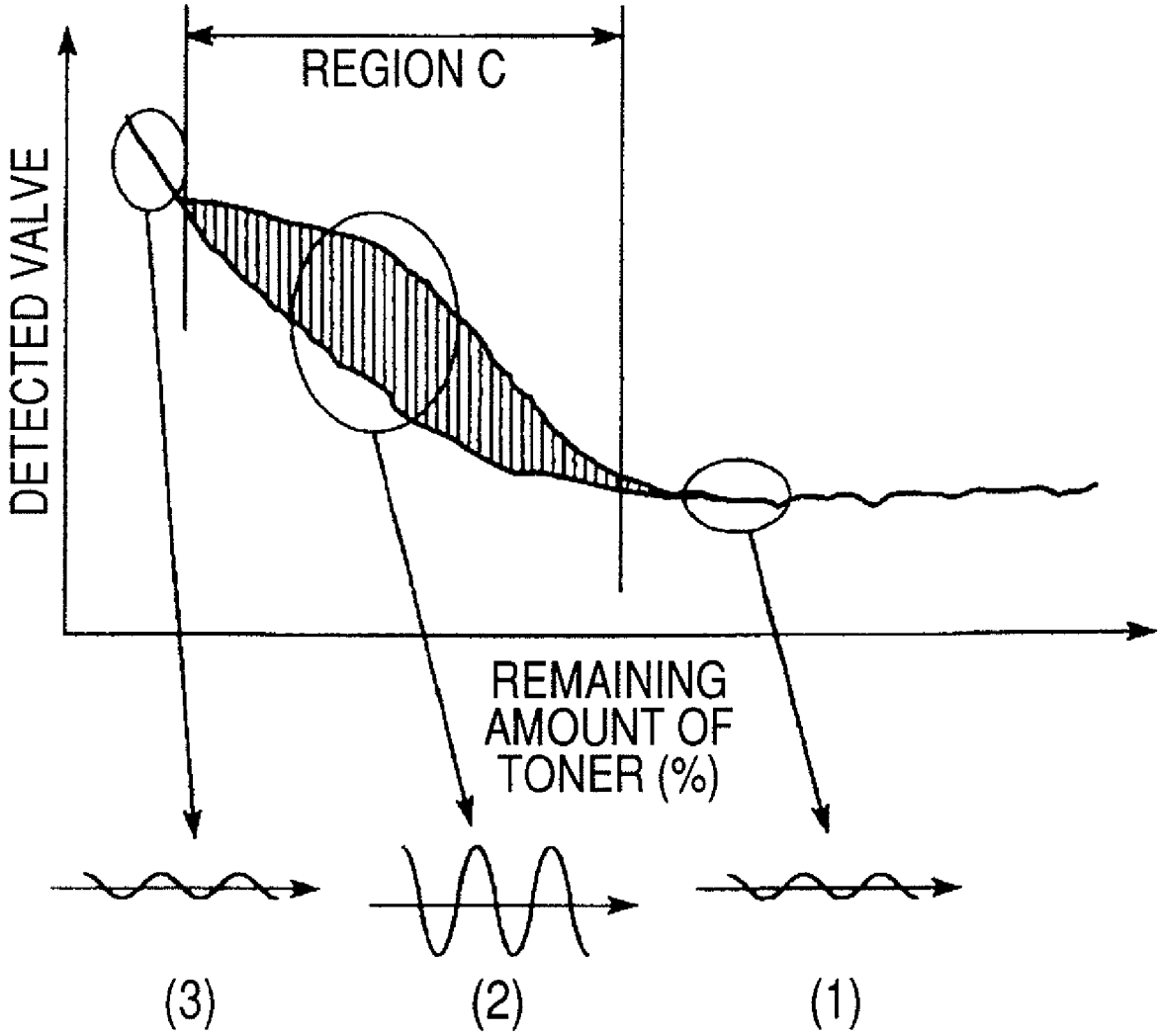
FIG. 19 is a graph diagram illustrating a relation between the remaining amount of toner and fluctuation in detected values.

As illustrated in FIG. 17, detected values (V) are changed as the toner remaining amounts change. To observe the change of detected voltages in detail, however, as illustrated in FIG. 19, detected voltages are found to go up and down in synchronization with the period of rotation of an agitating member 10. The reason thereof is, as illustrated in FIG. 20, that an amount of toner between the PA metal plates 15 and 16 changes in association with movement of the agitating member 10.

Figure 20A:
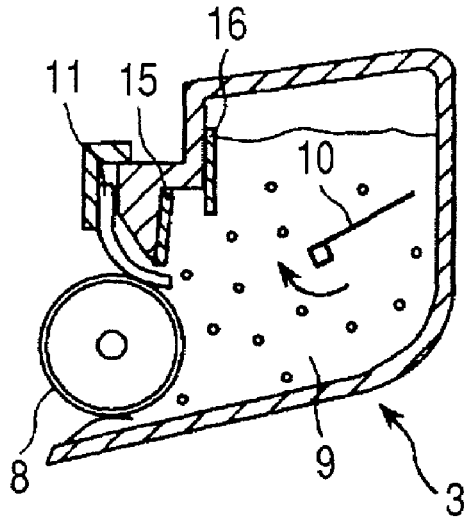
FIGS. 20A, 20B, 20C and 20D are schematic cross-sectional views illustrating the movement of toner and agitation in the developing device.

When toner between the PA metal plates 15 and 16 is largely moved, since capacitances C3 change, detected values largely fluctuate. As illustrated in FIG. 20A, in the state in which toner sufficiently remains (corresponding to FIG. 19(1)), toner between the PA metal plates 15 and 16 do not largely change even if the agitating member 10 is rotated, and thus detected values do not fluctuate much in the period of agitation.

Figure 20B:
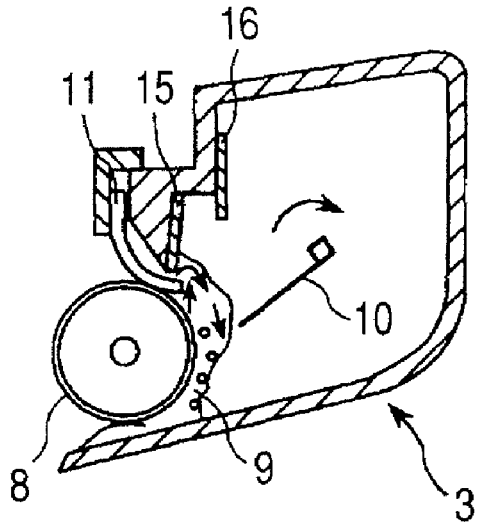

Likewise, as illustrated in FIG. 20B, also in the state in which there are substantially small amounts of toner (corresponding to FIG. 19(3)), since the agitating member 10 has not reached the region in which toner is resided even if the agitating member 10 rotates, toner T moves only in the vicinity of the developing sleeve 8 and the developing blade 11 as indicated by the arrow in the drawing. Accordingly, detected values hardly fluctuate in the period of agitation.

Figure 20C:
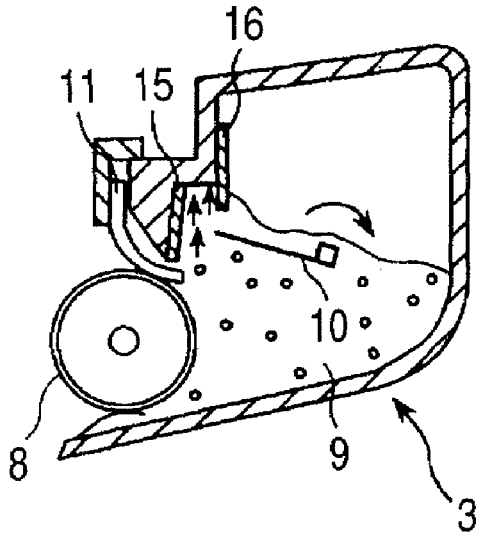
Figure 20D:
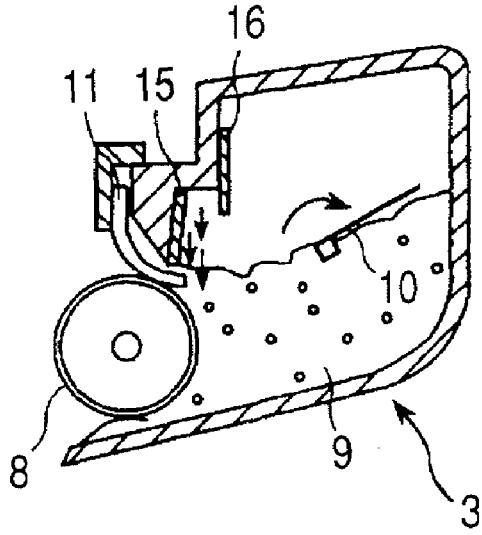
Figure 21:
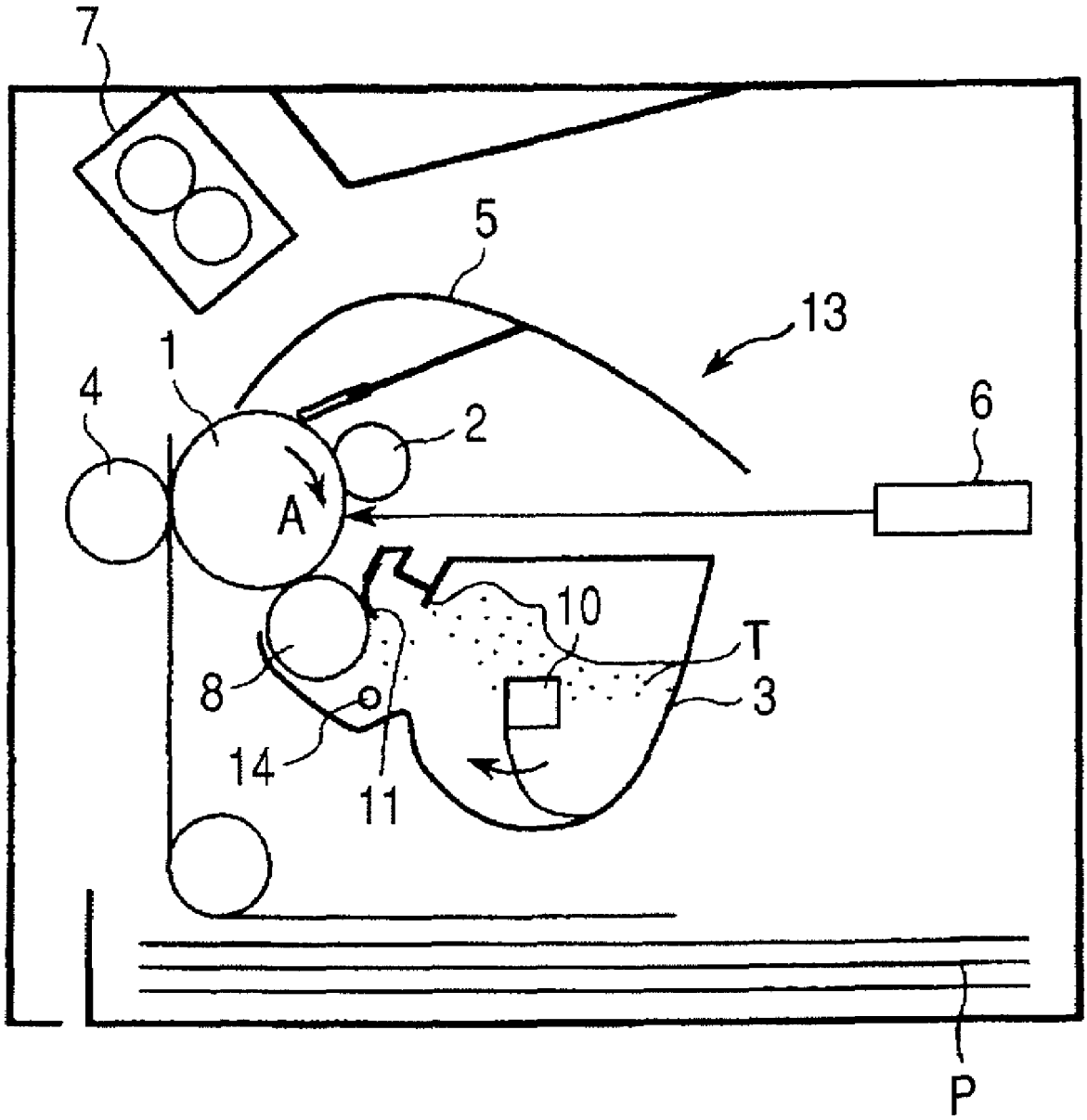
FIG. 21 is a schematic cross-sectional configuration diagram illustrating one example of a conventional image forming apparatus.
Figure 22:
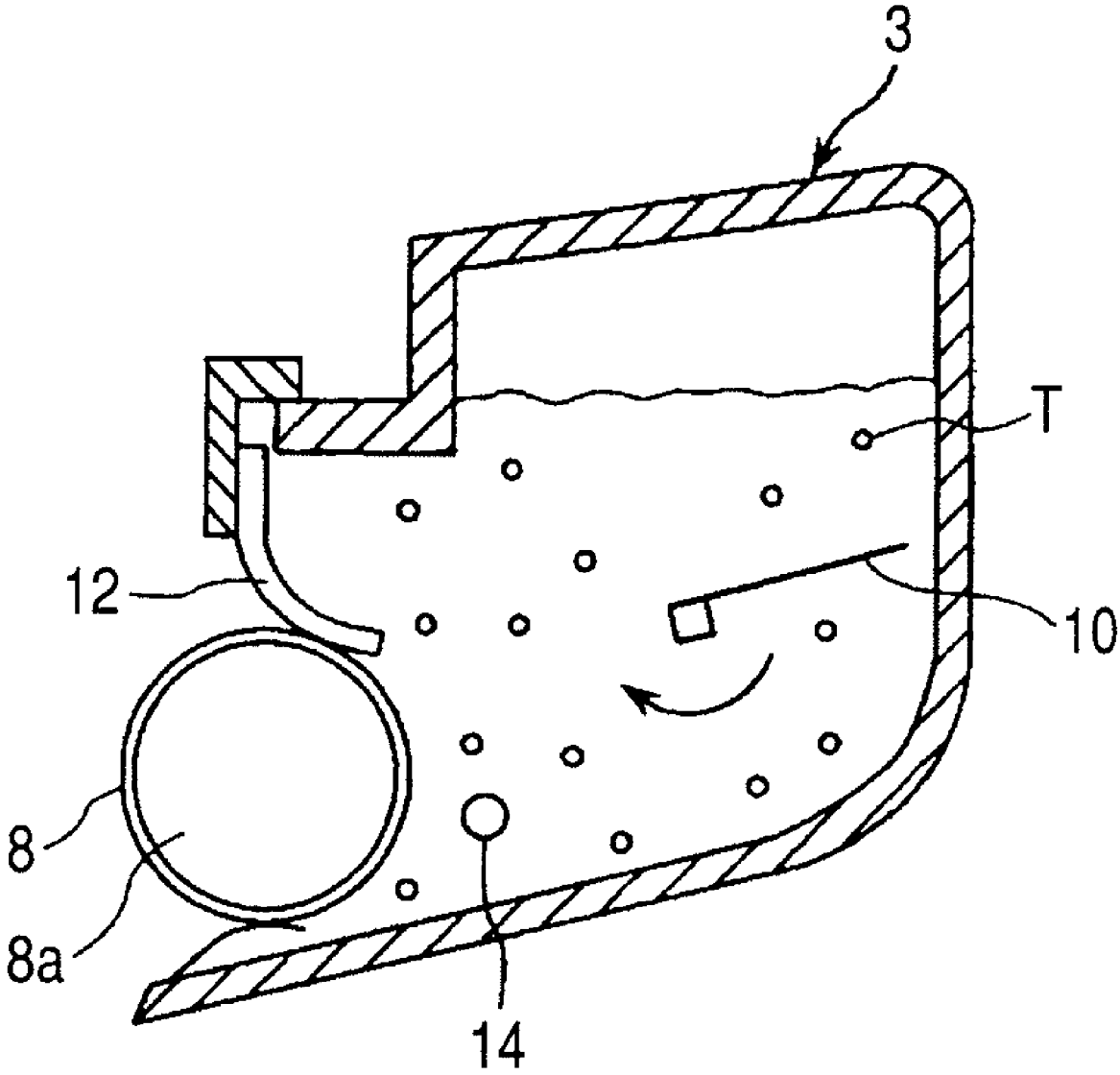
FIG. 22 is a schematic cross-sectional configuration diagram of one example of a conventional developing device.

As illustrated in FIGS. 20C and 20D, however, in the case of a certain amount of toner, toner amounts between the PA metal plates 15 and 16 largely change by the rotation of the agitating member 10. Therefore, detected vales largely fluctuate in the period of agitation (corresponding to FIG. 19(2)). In the case where the agitating member 10 pushes toner between the PA metal plates 15 and 16 as illustrated in FIG. 20C, the capacitance between the PA metal plates 15 and 16 becomes large, and thus a detected value becomes small. On the other hand, when the agitating member 10 goes away from the PA metal plates 15 and 16 as illustrated in FIG. 20D, toner drops from between the PA metal plates 15 and 16 owing to gravity, the capacitance therebetween becomes small, and thus a detected value becomes large. Since these states are repeated in the period of agitation, fluctuation in detected values are significantly large in a region C of FIG. 19.

Particularly, in this embodiment, due to that the PA metal plates 15 and 16 are disposed over the developing sleeve 8, toner can surely come in or out of the space between the PA metal plates 15 and 16, and there are no effects of the agitating member 10 at a time point when the amount of toner is decreased to a certain amount.

Also in the image forming apparatus according to this embodiment, the same developer remaining amount detecting method as described in the first and second embodiments is employed, thus enabling to make toner remaining amount detection with higher accuracy.

Other Embodiments

In the above-mentioned first to third embodiments, the case in which increase and decrease relation between a capacitance value detected with a developer remaining amount detecting unit and a detected value of the developer remaining amount detecting portion 18 is set to be inverted (when a capacitance value is decreased, a detected value is increased), is described. However, this relation is varied with circuits provided in an image forming apparatus. The relation between a capacitance and a voltage may be in the same decreasing function or in the same increasing function.

Although a metal plate is employed as a detecting unit of the remaining amount of toner in the above-mentioned first to third embodiments, there may be provided more developer remaining amount detecting members in order to achieve higher detection accuracy of the remaining amount of toner.

Furthermore, toner remaining amount detection in the above-mentioned first to third embodiments is in toner near end indication in which remaining amount detection can be sequentially made from a time point when the remaining amount of toner becomes small. To make toner remaining amount detection from a time point when larger amounts of toner remain, however, other developer remaining amount detecting units may be used in combination. For example, by provision of an electrode member at the bottom of a developing container, the remaining amount of toner may be sequentially detected from a time point of a larger remaining amount of toner. Sequential detection of developer remaining amounts includes not only that remaining amounts of developer are sequentially detected in all regions from the state of 100% to the state of 0%, but also that remaining amounts of developer are sequentially detected from the states in which a developer is so decreased further as 50% or 15%. Moreover, 0% of developer remaining amount means not only that any developer does not remain in a developing device, but also includes the state in which, for example, letting 0% the remaining amount of a developer with which images of a predetermined quality is hard to obtain, a predetermined amount of developer having been preliminarily determined remains.

As a developer remaining amount detecting unit, due to high detection accuracy and comparatively simple circuit arrangement, capacitance detecting methods described in the above-mentioned first to third embodiments are favorable. However, the present invention is not limited to these methods. Also in the case of employing other methods in which signals corresponding to remaining amounts of a developer in a developing containing portion can be output in sequence, as well as remaining amounts of a developer can be obtained corresponding to the rate of change of detected output values from the output reference value corresponding to the maximum remaining amount of a developer, the present invention can be likewise applied. A plurality types of developer remaining amount detecting units may be used in combination.

In the above-mentioned embodiments, a cartridge detachably mountable to an apparatus main body is described to be a process cartridge 13 in which a photosensitive drum 1, a charging roller 2, a developing device 3, and a cleaning device 5 are integrally configured to be in a cartridge. However, the present invention is not limited to this cartridge. Process cartridges include those in which a photosensitive member and at least one of a charging unit, a developing unit and a cleaning unit as a process unit acting on the photosensitive member are integrally configured to be in a cartridge, to be detachably mountable to the apparatus main body.

Also in the case where a developing device (developing cartridge) is solely detachably mountable to an apparatus main body as a cartridge detachably mountable to the apparatus main body, the present invention is equally applicable. In this case, a developing cartridge is configured to be the one in which the photosensitive drum 1, the charging roller 2, and the cleaning device 5 are excluded from the process cartridge 13 in each of the above-mentioned embodiments, and the cartridge-side memory 9 may be thought to be provided in this developing cartridge.

Furthermore, also in the case where a developing container is solely detachably mountable to an image forming apparatus main body as a cartridge detachably mountable to the image forming apparatus, the present invention is equally applicable. That is, as a cartridge, a developer containing portion, a developer remaining amount detecting unit capable of sequentially outputting signals corresponding to remaining amounts of a developer in this developer containing portion, and a storage medium have only to be integrally detachably mountable to the image forming apparatus main body.

Although, in the above-mentioned first to third embodiments, an image forming apparatus is described to form monochrome images, the present invention is not limited thereto. Also in an image forming apparatus that includes a plurality of developing units, and forms multi-color images (for example, two-color images, three-color images, full color images or the like), the present invention is equally applicable. In this case, with respect to each developer containing portion containing a developer for use in each developing unit, toner remaining amount detecting control may be made as in the above-mentioned first to third embodiments.

As a developing method, not only jumping development using a mono-component magnetic developer in the above-mentioned first to third embodiments, but also various developing methods such as known two-component magnetic brush development can be employed.

Moreover, although, in the above-mentioned first to third embodiments, a laser beam printer is illustrated by example as an image forming apparatus, the present invention is not limited thereto. The present invention is applicable to other image forming apparatuses such as copying machines, facsimiles, or word processors using a cartridge detachably mountable to an apparatus main body e.g., a process cartridge or a developing cartridge.

Hereinbefore, according to the present invention, detection accuracy of the remaining amount of a developer in a developer containing portion in a developing device is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-055608, filed Mar. 1, 2006, and No. 2007-044762, filed Feb. 23, 2007, which are hereby incorporated by reference herein in their entirety.

What is claimed is:

1. An image forming apparatus, which uses a developing device including: a developer carrying member for developing an electrostatic latent image formed on an electrophotographic photosensitive member with a developer; a developer containing portion containing the developer; an agitating member provided rotatably in the developer containing portion to agitate the developer; and a developer remaining amount detecting member outputting a signal for detecting a remaining amount of the developer contained in the developer containing portion, the developer remaining amount detecting member being disposed at a position closer to the developer carrying member than to a center of rotation of the agitating member in the developer containing portion, the image forming apparatus comprising:

a main body controller to which the signal is input, and which determines the remaining amount of the developer, the main body controller determining the remaining amount of the developer in the developer containing portion and indicating that the remaining amount of the developer in the developer containing portion reaches a predetermined amount after an amount of change per a unit revolution number of the agitating member in a band of fluctuation in the signal in association with a rotation of the agitating member becomes zero.

2. An image forming apparatus according to claim 1, wherein the developer remaining amount detecting member is disposed vertically above the center of rotation of the agitating member.

3. An image forming apparatus according to claim 1, wherein the developer remaining amount detecting member includes an antenna member provided in the developer containing portion, the antenna member outputting a signal corresponding to electrical capacitance between the developer carrying member and the antenna member.

4. An image forming apparatus according to claim 1, wherein the developer remaining amount detecting member includes a first antenna member to which a predetermined voltage is applied, and a second antenna member outputting a signal corresponding to electrical capacitance generated by the voltage applied to the first antenna member, the first and second antenna members being provided in the developer containing portion.

5. A detecting method of detecting a remaining amount of a developer contained in a developer containing portion, in an image forming apparatus, which uses a developing device including: a developer carrying member for developing an electrostatic latent image formed on an electrophotographic photosensitive member with a developer; the developer containing portion containing the developer; an agitating member provided rotatably in the developer containing portion to agitate the developer; and a developer remaining amount detecting member outputting a signal for detecting the remaining amount of the developer contained in the developer containing portion, the developer remaining amount detecting member being disposed at a position closer to the developer carrying member than to a center of rotation of the agitating member in the developer containing portion, the detecting method comprising:

determining the remaining amount of the developer in the developer containing portion and indicating that the remaining amount of the developer in the developer containing portion reaches a predetermined amount after an amount of change per a unit revolution number of the agitating member in a band of fluctuation in the signal in association with a rotation of the agitating member becomes zero.

6. A detecting method according to claim 5, wherein the developer remaining amount detecting member is disposed vertically above the center of rotation of the agitating member.

7. A detecting method according to claim 5, wherein the developer remaining amount detecting member outputs a signal corresponding to electrical capacitance between the developer carrying member and an antenna member provided in the developer containing portion.

8. A detecting method according to claim 5, wherein the developer remaining amount detecting member includes a first antenna member to which a predetermined voltage is applied, and a second antenna member outputting a signal corresponding to electrical capacitance generated by the voltage applied to the first antenna member, the first and second antenna members being provided in the developer containing portion.

* * * * *